US005328795A

United States Patent [19]

Yamashiro et al.

[11] Patent Number: 5,328,795

[45] Date of Patent: Jul. 12, 1994

[54] TONERS FOR USE IN ELECTROPHOTOGRAPHY AND PRODUCTION THEREOF

[75] Inventors: Jiro Yamashiro; Harushi Nagami; Takashi Miki; Mitsuhiro Uchino, all of Kobe, Japan

[73] Assignee: Bando Chemical Industries, Ltd., Kobe, Japan

[21] Appl. No.: 501,136

[22] Filed: Mar. 29, 1990

[30] Foreign Application Priority Data

| | | | |
|---|---|---|---|
| Mar. 29, 1989 | [JP] | Japan | 1-79392 |
| Mar. 29, 1989 | [JP] | Japan | 1-79393 |
| Mar. 29, 1989 | [JP] | Japan | 1-79394 |
| Mar. 29, 1989 | [JP] | Japan | 1-79395 |
| Mar. 29, 1989 | [JP] | Japan | 1-79396 |
| Mar. 29, 1989 | [JP] | Japan | 1-79397 |

[51] Int. Cl.[5] ..... G03G 9/08

[52] U.S. Cl. ..... 430/137; 430/111

[58] Field of Search ..... 430/111, 107

[56] References Cited

U.S. PATENT DOCUMENTS

| | | | |
|---|---|---|---|
| 2,965,573 | 12/1960 | Gondlach | 430/111 |
| 4,171,274 | 10/1979 | Schwarz | 430/111 |
| 4,472,490 | 9/1984 | Yubakami et al. | 430/111 |

*Primary Examiner*—John Goodrow

*Attorney, Agent, or Firm*—Wenderoth, Lind & Ponack

[57] ABSTRACT

There is disclosed a method of producing a toner particles for use in electrophotography which comprises: suspending a radical polymerizable monomer which contains a colorant and a charge controlling agent therein in an aqueous phase; suspension polymerizing the monomer to provide spherical polymer particles of 1–30 μm in diameter; treating the suspension containing the polymer particles with a continuous, wet type, agitation mill, to deform the polymer particles.

A further method of producing toner particles is disclosed which comprises: producing spherical polymer particles by suspension polymerization of a monomer; making finely divided triboelectric or electroconductive particles or both onto the surface of the polymer particles; and then mechanically pressing the polymer particles to deform the polymer particles as well as to fix the particles on the surface of the polymer particles.

A still further method of producing toner particles is disclosed which comprises: producing spherical polymer particles of 20–300 μm in diameter by suspension polymerization of a monomer; and then crushing and classifying the polymer particles into toners of 1–30 μm in size preferably after deforming the polymer particles.

7 Claims, 2 Drawing Sheets

TONERS FOR USE IN ELECTROPHOTOGRAPHY AND PRODUCTION THEREOF

FIELD OF THE INVENTION

This invention relates to toners for use in electrophotography and production thereof.

BACKGROUND OF THE INVENTION

Toners or developing agents in the form of finely divided particles for developing electrostatic latent images in electrophotography have been heretofore produced by a so-called crushing method. According to this method, a colorant such as carbon black, an electric charge controlling agent such as a certain dyestuff, and an anti-offset agent such as a wax are mixed and kneaded together with a melted thermoplastic resin, thereby to disperse them in the resin, cooling, crushing and pulverizing the resultant solid mixture with, for example, a jet mill, to powders of a desired particle size.

In this method, it is necessary that the resin used be brittle so that a mixture of the resin and the additives as mentioned above be readily crushed. However, when a resin used is too brittle, the resultant toner is excessively finely divided during the use in an electrophotographic apparatus, and contaminates the inside of the apparatus or forms fog on developed positive images. On the other hand, when a resin used is readily melted, the resultant toner is apt to aggregate together and is undesirably reduced in fluidity, but also there takes place filming on an photoconductive body to deteriorate quality of positive images.

It is also necessary that individual toner particles have colorants and charge controlling agents equally and finely dispersed therein, and be capable of being equally electrified so as to produce high quality positive images. However, according to the conventional crushing method, colorants and charge controlling agents are unequally divided among individual toner particles with varied particle sizes. Thus, it is inevitable that positive images have background contamination as well as fog thereon. The apparatus is also contaminated.

In particular, a charge controlling agents has an important effect upon copying performance of toners, but since the known charge controlling agents are in many cases 1–20 μm in particle size, much time is needed to disperse the agent in a resin and thus productivity is low. Moreover, as a matter of fact, the agent can not be uniformly dispersed in a resin even after kneading over a long period of time.

As above set forth, the conventional crushing method has many disadvantages, and therefore there have been proposed in recent years many methods to produce toners directly by suspension or emulsion polymerization of a radical polymerizable monomer which contains colorants therein such as carbon black. In these methods, an oily monomer phase is polymerized in an aqueous phase containing a suspending agent dissolved therein such as polyvinyl alcohol. Accordingly, at least some portions of the suspending agent remain inevitably on the surface of the resultant polymer particles even after repeated washing, so that the polymer particles are very sensitive to humidity. Thus, such toners are low in triboelectricity under high humidity, and are apt to produce noncharged or reversely charged toners during the use, to provide a toner image with undesired fog or a toner image with an insufficient darkness.

It is an advantage of the toners produced by a conventional suspension or emulsion polymerization method that the toner is substantially spherical and has a high fluidity so that there is no need of adding a fluidizing agent such as silica to the toner. But, because of that sphericity, the toner is inferior in "blade cleanability".

In an electrostatic photography using plain paper as a substrate on which toner images are fixed, an latent image is formed on the surface of an photoconductive body to which electrostatic charges have been given, the latent image is developed by the toner to a toner image, and the toner image is transferred onto a substrate, and then the toner image is fixed thereon, to provide a copy. Therefore, it is necessary that the toner remaining on the photoconductive body is removed therefrom after the toner image has been transferred onto the substrate to copy in succession. As one of the methods for removing the toner remaining on the photoconductive body, a blade cleaning method is known according to which the toner is scraped off with a cleaning blade after the toner image has been transferred onto the substrate. The blade is formed of various elastomers, among which a polyurethane elastomer is most preferred from the standpoint of mechanical properties such as resistance to abrasion.

In such a blade cleaning method, spherical toner particles enter beneath the blade when the blade scrapes the photoconductive body and roll between the blade and the surface of photoconductive body, so that the toner remains on the photoconductive body after the cleaning of the body with the blade.

Thus, in the production of toner particles by suspension polymerization, there has been proposed a method in which spherical polymer particles are agitated in a suspension medium at a high rate before the completion of the polymerization so that the spherical polymer particles are deformed, as described in Japanese Patent Application Laid-open No. 62-266560. However, according to the method, the polymer particles are apt to aggregate to each other on account of unreacted monomers remaining in the reaction system or the deformed polymer particles are restored to their original spherical particles at relatively high temperatures where the polymer particles are readily deformed, on account of surface tension they possess. Namely, effective deformation of spherical polymer particles is not attained. Agitation of the polymer particles at small rates or at low temperatures also fails to effectively deform the spherical polymer particles, although the aggregation of the particles is restrained. Furthermore, the polymer particles produced by the suspension polymerization have rather a wide particle size distribution. Thus, large spherical particles might be readily deformed, but small particles are not, and accordingly there arises a wide distribution in degree of deformation. Accordingly, as a further defect of the above method, small spherical particles remain undeformed and such small spherical particles elude cleaning by a blade on the photoconductive body.

A further method of producing toners has been recently proposed in which finely divided particles are adhered and fixed onto the toner particles by a so-called impact method, as described in Japanese Patent Application Laid-open No. 62-128866. However, since toner particles have a significant size distribution, it is necessary that the finely divided particles are of not more than about 1 μm so that they are successfully fixed on the individual toner particles according to this method. Little improvement in blade cleanability is attained with such toner particles having such fine particles forced thereon.

Meanwhile, there is disclosed a method of improving triboelectricity of toner particles in Japanese Patent Application Laid-open No. 62-140636 or No. 62-246075. In this methods, finely divided triboelectric or electroconductive particles are forcibly made to collide with the surface of toner particles at high velocity, or toner particles are softened in a hot air stream and such particles are adhered onto the surface of toner particles. This method is not applicable, however, to deformed toner particles since the deformed toner particles have a tendency to become spherical under the conditions employed. In conclusion, no method has hitherto been known which improves both triboelectricity and blade cleanability of toner particles.

STATEMENTS OF OBJECTS

The present invention has been accomplished to solve the problems involved in the conventional toner particles and their production.

Therefore, the general object of the invention is to provide toners for use in electrophotography which are improved in blade cleanability and a method for the production of such toners.

More specifically, it is an important object of the invention to provide toners which contain carbon black and a charge controlling agent divided equally and finely among individual particles, and are free from undesirable effects deriving from a suspension agent used in suspension polymerization, and in addition, which are deformed and has excellent blade cleanability, and hence produce high quality toner images irrespectively of ambient conditions.

It is also an object of the invention to provide a method for producing such toners.

It is another important object of the invention to provide a method for producing toner particles which are deformed in shape and are improved in triboelectricity as well as blade cleanability.

It is still an object of the invention to provide a method for producing toners particles which includes steps of suspension polymerization, deforming the resultant spherical polymer particles and then pulverizing the deformed particles in sequence to deformed or irregularly shaped toner particles having excellent blade cleanability.

It is likewise an object of the invention to provide a method for producing toner particles which includes steps of suspension polymerization and pulverizing the resultant spherical polymer particles followed by deforming the particles into toner particles having excellent blade cleanability.

It is a further object of the invention to provide a method for producing toners which includes a step of suspending polymerization in the presence of polyvinyl alcohol as a suspensing agent, and which nevertheless provides toners having hydrophobic surface.

As an important aspect of the invention, there is provided a process of producing toners which includes a step of suspension polymerization, and nevertheless which provides toners having narrow particle size distribution without classification.

BRIEF DESCRIPTION OF DRAWINGS

Other features and advantages of the invention will be apparent from the following description taken in connection with the accompanying drawings, in which.

DETAILED DESCRIPTION OF THE INVENTION

PART A

Figure 1:
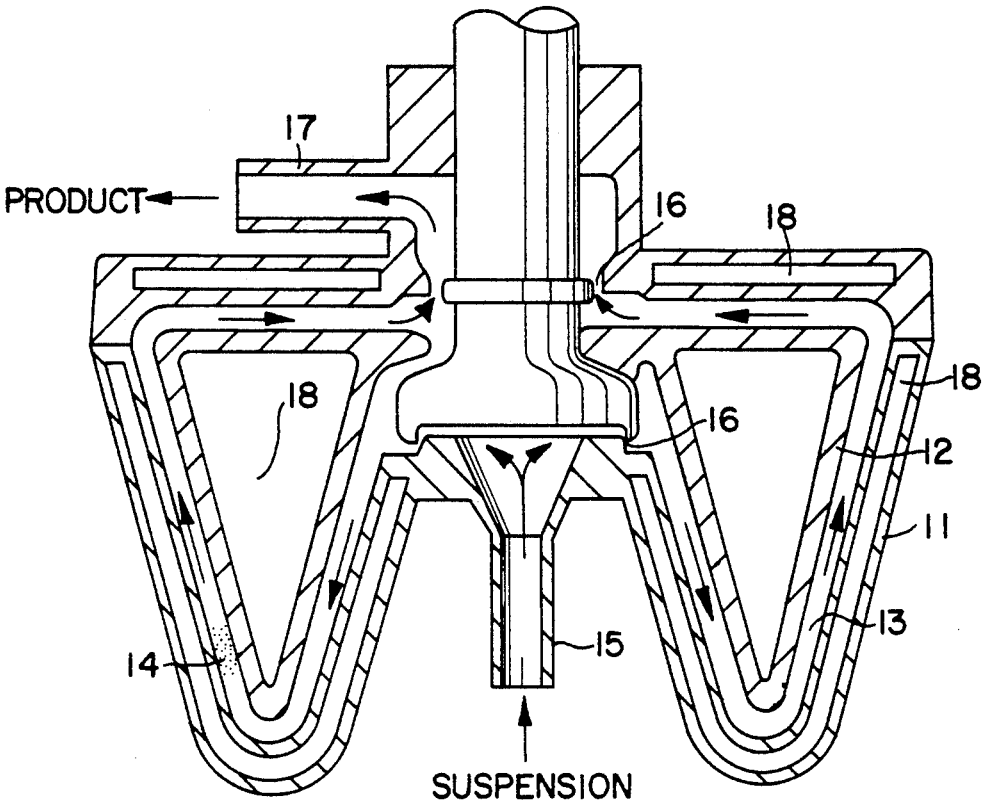
FIG. 1 is a sectional view of a continuous, wet type agitation mill preferably used for the production of deformed polymer particles according to an embodiment of the present invention.

Production of Deformed Toners Using Wet Type Agitation Mill

According to the invention, there is provided a dislike toner particle having a diameter of 3–30 μm, a thickness of 1–15 μm and a flatness of not more than 0.5 as the flatness of dislike toner particle is herein defined as a ratio of average thickness to average diameter of the particle.

A further toner particle of the invention is oval and has a major axis 3–30 μm in length, a minor axis 1–25 μm in length and a flatness of not more than 0.5 as the flatness of oval toner particle is herein defined as a ratio of twice the average thickness to the sum of average major axis and the average minor axis.

The toner particle of the invention may be a mixture of the disklike and oval toner particles.

Such toner particles of the invention can be produced by suspending a radical polymerizable liquid monomer containing carbon black and a charge controlling agent in water, suspension polymerizing the monomer to provide spherical polymer particles composed of a matrix of the polymer and the carbon black and charge controlling agent dispersed therein and having a diameter of 1–30 μm, and treating the suspension containing the polymer particles at temperatures in the range of ±10° C. of the glass transition temperature of the matrix forming the polymer particles with a continuous, wet type agitation mill, thereby to deform the polymer particles so that they have a disklike or oval shape.

More specifically, the above mentioned disklike or oval toner particle is advantageously produced by a method comprising the following steps carried out in sequence:

(a) the step of dispersing carbon black and a charge controlling agent minutely and uniformly both as finely divided particles of not more than 1 μm in particle size in a radical polymerizable liquid monomer;

(b) the step of adding an azobisnitrile polymerization initiator to the resultant monomer composition, suspending the composition in water containing polyvinyl alcohol as a suspending agent, suspension polymerizing the monomer to provide spherical polymer particles composed of a matrix of the polymer and the carbon black and charge controlling agent dispersed therein and having a diameter of 1–30 μm, and treating the suspension containing the polymer particles at temperatures in the range of ±10° C. of the glass transition temperature of the matrix forming the polymer particles with a continuous wet type agitation mill, thereby to deform the spherical particles into disklike or oval particles;

(c) the step of saponifying the polyvinyl alcohol;

(d) the step of recovering, drying and washing the polymer particles, and when necessary classifying to a desired particle size.

Any radical polymerizable monomer which is known as usable for the production of toner by suspension polymerization is usable in the invention. Therefore, such monomers include, for example, styrene, substituted styrenes such as o-methylstyrene, m-methylstyrene, p-methylstyrene or p-chlorostyrene; vinyl esters such as vinyl acetate or vinyl propionate; acrylic acid esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, phenyl acrylate or α-chloromethyl acrylate; methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, α-chloromethyl methacrylate, dimethylaminoethyl methacrylate, diethylaminoethyl methacrylate or glycidyl methacrylate; unsaturated nitriles such as acrylonitrile or methacrylonitrile; α,β-unsaturated carboxylic acids such as acrylic acid or methacrylic acid; and vinylpyridines such as 2-vinylpyridine or 4-vinylpyridine. These monomers are used singly or as a mixture of two or more. Among these, however, styrene or a mixture of styrene and acrylic or methacrylic acid esters are preferred.

A polyfunctional monomer may be used together with the above mentioned monomers to improve fixation and anti-offset properties of toners. There may be mentioned as such a polyfunctional monomer, for example, divinylbenzene or ethylene glycol dimethacrylate. However, a variety of polyfunctional monomers are already known in the art, and any one of these may be used, if desired. The polyfunctional monomer may be used normally in amounts of not more than about 1% by weight based on the radical polymerizable monomer. When the polyfunctional monomer is used in excess, the resultant polymer particles are too high in melting points to fix sufficiently on a substrate.

According to the invention, carbon black as a colorant and a charge controlling agent are dispersed minutely and finely both as finely divided particles of not more than 1 μm in particle size in the radical polymerizable monomer. For this purpose, the monomer and carbon black are stirred in the presence of a peroxide polymerization initiator with, for example, a ball mill. The peroxide polymerization initiator used includes, for instance, benzoyl peroxide, lauroyl peroxide, o-chlorobenzoyl peroxide and o-methoxy benzoyl peroxide, and especially lauroyl peroxide is preferred. Usually the mixture of the monomer and carbon black is stirred in the presence of the peroxide polymerization initiator over a period of several hours, thereby to dispese the carbon black evenly in the monomer as finely divided particles of not more than 1 μm in particle size, preferably of not more than 0.5 μm in particle size. The dispersion of carbon black in the monomer may be carried out at room temperatures, but if desired, at elevated temperatures, for example, at about 50°-80° C. to accelerate the dispersion.

Carbon black is used in amounts of about 2-10 parts by weight in relation to 100 parts by weight of the radical polymerizable monomer. In turn, the peroxide polymerization initiator is used usually in amounts of about 10-50 parts, preferably of about 10-40 parts by weight, in relation to 100 parts by weight of carbon black used. The use of the peroxide polymerization initiator in amounts of less than about 10 parts by weight in relation to 100 parts by weight of carbon black used fails to disperse carbon black minutely and uniformly in the monomer, whereas the use of the peroxide polymerization initiator in amounts of more than about 50 parts by weight in relation to 100 parts by weight of carbon black used, the decomposition fragments of the initiator remain in the resultant polymer particles. Such polymer particles undesirably smell bad when being heated and melted to fix on a substrate during electrophotographic process.

The use of an azobisnitrile polymerization initiator, such as azobisisobutyronitrile or azobisdimethylvaleronitrile, in place of a peroxide polymerization initiator in the step of the carbon black dispersion, fails to uniformly and minutely disperse carbon black in the monomer, but carbon black aggregates together, and most of the carbon black used are dispersed as large particles in the monomer. Furthermore, the monomer in part polymerizes in the presence of the azobisnitrile polymerization initiator, to increase the viscosity of the mixture of the monomer and the carbon black. This adversely affects the preparation of suspension of fine droplets of the monomer composition in an aqueous medium.

In the dispersion of carbon black in the monomer in the presence of a peroxide polymerization initiator, the carbon black and the peroxide may be added together to the monomer and then the carbon black may be dispersed in the monomer by use of, for instance, a ball mill, or the carbon black may be in advance dispersed preliminarily in the monomer and then a peroxide may be dissolved thereinto, followed by stirring, for example, in an autoclave.

Any colorant may be used, together with carbon black, if needed. Such colorants may or may not be soluble in the monomer. There are mentioned such colorants in, for example, Japanese Patent Application Laid-open No. 62-246073. When a colorant insoluble in the monomer is used, such a colorant may be dispersed minutely and uniformly in the monomer with aid of a peroxide polymerization initiator or other suitable dispersing agent in the same manner as carbon black is dispersed in the monomer.

After the dispersion of carbon black in the monomer as set forth above, a charge controlling agent is then dispersed evenly as finely divided particles in the monomer mixture with carbon black. Usually a charge controlling agent is added to the monomer mixture together with a dispersing agent soluble in the monomer, and the resultant mixture is stirred for, for example, about 50-200 hours, with a ball mill, thereby to pulverize and disperse the agent evenly as finely divided particles of not more than about 0.5 μm, preferably of not more than about 0.3 μm in the monomer. This dispersion may also be carried out at elevated temperatures such as at about 50°-80° C. to accelerate the dispersion.

The charge controlling agent is used usually in an amount of about 0.01-10 parts, preferably of about 0.05–5 parts, most preferably of about 0.1–1 parts by weight, in relation to 100 parts by weight of the monomer used.

The charge controlling agent used is at least one selected from the group consisting of a powder of an inorganic compound, a powder of an organic compound including metallized dyes and pigments, and organic carboxylic acid metal salts, and a powder of an organic polymer.

The powder of inorganic compound as a charge controlling agent includes, for example, nitrides, carbides, oxides, sulfates, carbonates, titanic acid salts, phosphoric acid salts, silicates and hexafluorosilicates. More specifically, there may be mentioned as such inorganic compounds, for example, nitrides such as boron nitride; carbides such as titanium carbide, tungsten carbide, zirconium carbide, boron carbide or silicon carbide; oxides such as silica, chromium oxide, cerium oxide, zirconium oxide, titanium oxide, magnesium oxide, aluminum oxide, copper oxide, nickel oxide or zinc oxide; strontium sulfate, barium sulfate, calcium sulfate, aluminum sulfate, magnesium sulfate or copper sulfate; carbonates such as calcium carbonate or magnesium carbonate; phosphoric acid salts such as calcium phosphate; silicates of such as zirconium, copper, cobalt, nickel, magnesium, calcium, strontium, barium, aluminum or zinc; hexafluorosilicates of such as sodium, calcium, strontium, barium, zinc or aluminum. Further examples include emery, alundum, garnet, corundum, lime, tripolyphosphate, halloycite, bentonite, molybdenum acid chelate pigments and acidic terra.

These inorganic charge controlling agent may be coated with silane or titanium coupling agents. The coupling agent used is selected depending upon the triboelectricity of toners required. When a negatively charged toner is to be produced, a coupling agent which is readily negatively charged is used, for example, dichlorosilanes, and when a positively charged toner is to be produced, a coupling agent which is readily positively charged is used, for example, aminosilanes. Some examples of these coupling agents are described hereinbefore.

As the powder of organic compound as a charge controlling agent are usable a variety of compounds including metallized dyes and pigments but also carboxylic acid metal salts. There may be mentioned as a positive charge controlling agent, for example, an electron donating dye, such as a nigrosine dye represented by:

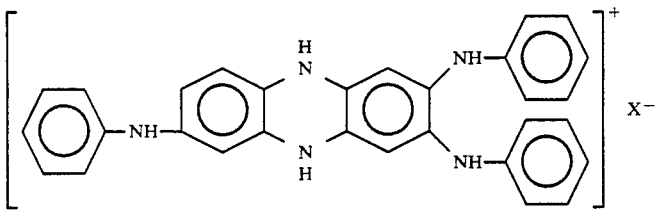

wherein $X^-$ is an anion species, an alkoxylated amine, an alkyl amide or a quaternary ammonium salt. On the other hand, there may be mentioned as a negative charge controlling agent, for example, an electron accepting dye, such as a chronium containing dye represented by:

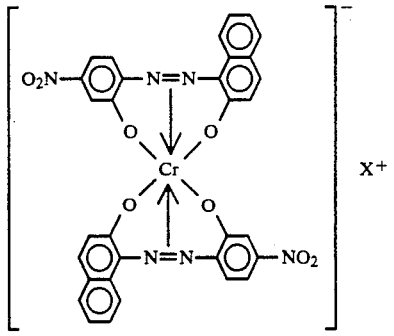

wherein $X^+$ is a cation species, and "Spiron Black TRH" (from Hodogaya Kagaku Kogyo K.K., Japan) represented by:

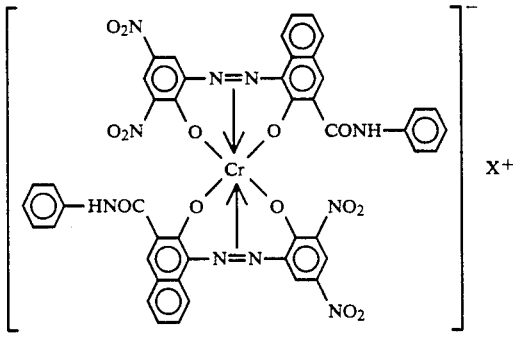

wherein $X^+$ is a cation species.

There may be further mentioned as a negative charge controlling agents, for example, sulfonyl amines of copper phthalocyanines, oil black, naphthenic acid metal salts and zinc stearate, resinous acid soaps.

A variety of organic polymers are also known as usable as a charge controlling agent, and a polymer is suitably selected depending upon the triboelectricity of toners required. When a negatively charged toner is to be produced, a polymer which is readily negatively charged is used, for example, a polymer or a copolymer of a monomer having an aromatic nucleus as an electron attracting group, such as styrene or derivatives thereof. Therefore, such polymers include, for example, polystyrene, styrene-butyl acrylate copolymer, styrene-2-ethylhexyl acrylate copolymer or styrene-butyl methacrylate copolymer. Polymers containing therein halogen atoms such as chlorine or fluorine are also usable as negative charge controlling agents, and they may be exemplified by polyvinyl chloride. When a positively charged toner is to be produced, a polymer which is readily positively charged is used, for example, polymethyl methacrylate, polybutyl methacrylate or polyamides. These polymeric charge controlling agents preferably have glass transition temperatures of not less than about 70° C.

The organic polymer used as a charge controlling agent is preferably produced by emulsion polymerization in the absence of an emulsifier so that the resultant polymer contains no emulsifier. However, an organic polymer produced in the presence of an emulsifier may be used if the emulsifier is removed.

Those charge controlling agent as described above may be used singly or as a mixture of two or more.

The dispersing agent used to disperse the charge controlling agent in the monomer may be either a low molecular weight substance or a high molecular weight substance. The low molecular weight substance includes, for example, surfactants, silane coupling agents, titanium coupling agents and oligomeric organic materials which contain therein isocyanate or epoxy groups.

More specifically, there may be mentioned as surfactants, for example, anionic surfactants such as fatty acid salts, alkylsulfuric acid esters, alkylbenzenesulfonic acid salts, alkylnaphthalenesulfonic acid salts, dialkylsulfosuccinic acid esters, alkylphosphoric acid esters, naphthalenesulfonic acid-formalin condensates or polyoxyethylene alkylsulfuric acid salts; nonionic surfactants such as polyoxyethylene alkyl ether, polyoxyethylene alkyl phenol ether, polyoxyethylene fatty acid esters, polyoxyethylene sorbitan fatty acid esters, polyoxyethylene alkyl amines, glycerine fatty acid esters or oxyethylene-oxypropylene block polymers; and cationic surfactants such as alkyl amines or quaternary ammonium salts.

The silane coupling agent may be exemplified by γ-chloropropyltrimethoxysilane, vinyltrichlorosilane, vinyltrimethoxysilane, vinyltriethoxysilane, γ-methacryloxypropyltrimethoxysilane, γ-glycydoxypropyltrimethoxysilane, γ-mercaptopropyltrimethoxysilane, γ-aminopropyltrimethoxysilane, γ-ureidopropyltriethoxysilane, 3,3,4,4,5,5,6,6,6-nonafluorohexyltrichlorosilane and 3,3,4,4,5,5,6,6,6-nonafluorohexylmethyldichlorosilane. Further, there may be mentioned as reactive silanes, for example, methyltrimethoxysilane, phenyltrimethoxysilane, methylphenyldimethoxysilane and diphenyldimethoxysilane.

The titanium coupling agent may be exemplified by isopropyltriisostearoyl titanate, isopropyltris(dioctylpyroohosphate) titanate, isopropyltris(N-aminoethylaminoethyl) titanate, tetraoctylbis(ditridecylphosphite) titanate, tetra-2,2-diallyloxymethyl-1-butyl bis(ditridecyl)phosphite titanate, bis(dioctylpyrophosphate)oxyacetate titanate, bis(dioctylpyrophosphate)ethylene titanate, isopropyltrioctanoyl titanate, isopropyldimethacrylisostearoyl titanate, isopropyltridecylbenzenesulfonyl titanate, isopropylisostearoyldiacryl titanate, isopropyltri(dioctylphosphate) titanate, isopropyltricumylphenyl titanate and tetraisopropylbis(dioctylphosphite) titanate.

On the other hand, the high molecular weight dispersing agent preferably includes homopolymers or copolymers which have functional groups therein, such as carboxyls, sulfones, hydroxyls, halogens, epoxys, cyanos, nitriles, butyrals, esters, carbonyls or aminos.

More specifically, the high molecular weight polymeric dispersing agent includes, for instance, vinyl (co)polymers, rubber polymers, cellulosic polymers and cross-linkable polymers. The vinyl (co)polymers includes, for example, styrene-acrylic acid copolymers, styrene-dimethylaminoethyl methacrylate copolymers, styrene-methacrylic acid copolymers, styrene-2-hydroxyethyl methacrylate copolymers, styrene-acrylonitrile copolymers, styrene-glycidyl methacrylate copolymers, methyl methacrylate-acrylic acid copolymers, methyl methacrylate-dimethylaminoethyl methacrylate copolymers, methyl methacrylate-methacrylic acid copolymers, methyl methacrylate-2-hydroxyethyl methacrylate copolymers, methyl methacrylate-acrylonitrile copolymers, methyl methacrylateglycidyl methacrylate copolymers, vinyl chloride-vinyl acetate copolymers, vinyl chloride-vinyl acetate-vinyl alcohol copolymers, polyvinyl butyral resins, vinylidene chlorideacrylonitrile copolymers, acrylonitrile-butyl acrylate-2-hydroxyethyl methacrylate copolymers, ethylene-vinyl acetate copolymers, polyvinyl acetate resins and partially sulfonated polystyrene resins. The rubber polymer includes, for example, acrylonitrile-butadiene copolymers, and the cellulosic polymer includes, for example, nitrocellulose and acetyl cellulose. The cross-linkable polymer includes, for instance, epoxy resins, phenoxy resins and urethane resins. These polymers may be used singly or as a mixture of two or more.

Most preferably, there is used, as a dispersing agent, a polymer having functional groups therein which have a strong interaction with a charge controlling agent used. By way of example, when an electron accepting dyes such as metallized azo dyes or an electron accepting organic complex is used as a negatively triboelectrified charge controlling agent, ethylene-vinyl acetate copolymers are preferably used as a dispersing agent.

In the dispersion of the charge controlling agent in the monomer, the amount of the dispersing agent used varies depending on the particle size of the charge controlling agent used, however, it is usually in amounts of about 1–100 parts, preferably of about 10–50 parts by weight, in relation to 100 parts by weight of the charge controlling agent used. When excessive amounts of the dispersing agent are used, the resultant mixture which contains the monomer, carbon black and charge controlling agent is too high, and the finely pulverizing of the charge controlling agent is not attained. When the dispersing agent is used only in small amounts, the charge controlling agent is not uniformly dispersed in the monomer.

Similarly to the dispersion of carbon black in the monomer, the charge controlling agent may be in advance preliminarily dispersed in the monomer using, for example, a ball mill, and then the dispersing agent may be dissolved in the monomer, followed by stirring, or the dispersing agent may be added to the monomer together with the charge controlling agent and stirred using, for example, a ball mill.

Some of the charge controlling agents have been found to inhibit undersired polymerization of monomers in an aqueous medium in suspension polymerization, which will be described in more detail hereinafter. Such a charge controlling agent is exemplified by "Spiron Black TRH" (by Hodogaya Kagaku Kogyo K.K., Japan), a chromium containing azo dye. Therefore, this dye is preferably used in the invention both as a charge controlling agent and as a polymerization inhibitor in an aqueous medium in suspension polymerization. However, if desired, the dye may be dispersed in monomers only as a polymerization inhibitor in an aqueous medium in suspension polymerization, apart from its original function as a charge controlling agent. In this case, other charge controlling agents may be dispersed together with the dye in monomers.

In the method of the invention, carbon black and a charge controlling agent are dispersed evenly as finely divided particles in the monomer as hereinbefore described, and if necessary an additional amount of the monomer are further added to the dispersion, and then an azobisnitrile polymerization initiatoris added to the dispersion, to form a monomer composition. The azobisnitrile polymerization initiator usable includes, for example, azobisdimethylvaleronitrile and azobisdimethylisobutyronitrile, however, azobisdimethylvaleronitrile is especially preferred since it is highly soluble in the monomer.

The monomer composition in the form of a dispersion thus containing an azobisnitrile polymerization initiator is then dispersed in an aqueous medium as small droplets by use of, for example, a homogenizer, and is heated so that suspension polymerization proceeds to produce spherical polymer particles.

When no azobisnitrile polymerization initiator is added anew to the monomer composition, substantially no suspension polymerization occurs even under heating, since substantially all the peroxide polymerization initiator which has been added to the monomer in the stage of the dispersion of carbon black in the monomer are decomposed during the dispersion, and therefore it is necessary that a polymerization initiator be anew added to the monomer in the stage of suspension polymerization. The polymerization initiator added in the stage of polymerization should be an azobisnitrile polymerization initiator, not a peroxide. The addition of a peroxide polymerization initiator is substantially useless since the initiator fails to polymerize the monomer, or if polymerization takes place, the resultant polymer has a very low molecular weight, and has insufficient anti-offset properties.

The azobisnitrile polymerization initiator is used usually in amounts of about 1-10 parts, preferably of about 2-5 parts by weight, in relation to 100 parts by weight of the monomer used. When the amount is less than about 1 part by weight in relation to 100 parts by weight of the monomer used, the polymerization proceeds only very slowly, and it is substantially impossible to polymerize the monomer in a high polymerization rate, while when the amount is more than about 100 parts by weight in relation to 100 parts by weight of the monomer used, the resultant polymer is low in molecular weight, and is insufficient in anti-offset properties.

As previously described, the mixture of the monomer, carbon black, an azobisnitrile polymerization initiator, and optionally a charge controlling agent are mixed with water, and severely stirred by use of, for example, a homogenizer, to provide an aqueous dispersion of droplets of the monomer composition of 1-30 μm in diameter in the aqueous medium.

It is preferred that the water as a dispersion medium in suspension polymerization contains polyvinyl alcohol as a suspending agent which has usually an average polymerization degree of 500-3000 and a saponification degree of about 80-90 mole %. The polyvinyl alcohol is contained in water usually in an amount of 0.1-5% by weight. The water may further contain a water soluble inorganic salts such as sodium chloride, sodium sulfate or aluminum sulfate to inhibit the polymerization of the monomer in an aqueous phase.

The suspension is then stirred at temperatures usually of about 40°-95° C., preferably of about 50°-90° C., to carry out suspension polymerization of the monomer to provide substantially true spherical polymer particles of 1-30 μm in diameter which has a flatness of not less than 0.98, the flatness being defined hereinafter.

In accordance with the invention, the suspension which contains the resultant substantially true spherical polymer particles is treated with a continuous wet type agitation mill in the presence of polyvinyl alcohol as a suspending agent at temperatures in the range of ±10° C. of the glass transition temperature of the matrix forming the polymer, thereby to deform the spherical particles into disklike or oval particles.

The continuous wet type agitation mill is known. As illustrated in FIG. 1, the mill contains an annular stator 11 having a triangular section and a rotor 12 therein similar to the stator in shape. A milling zone 13 is formed as an annular gap of a small breadth between the stator and the rotor. The milling zone contains a milling medium 14 therein to impart mechanical impact to suspended particles to deform them so that they get flat.

The suspension is introduced into the milling zone through an inlet 15 at the lower part of the mill and travels along the gap, and is then separated from the medium at a separator 16. The suspension which contains deformed polymer particles are obtained from an outlet 17. While the polymer particles in the suspension are deformed in the milling zone, warm water is supplied to passages 18 within the stator and the rotor to control the temperature of the suspension. The milling medium also travels centrifugally along the milling zone having a W-shaped section and returns to the inlet. Zirconia, glass or steel spherules of, for example, about 0.3-1.5 mm in diameter are used as the milling medium, although not limited thereto.

It is necessary that treatment of the suspension containing the polymer particles with the annular, continuous, wet type agitation mill is carried out at temperatures in the range of ±10° C. of the glass transition temperature of the matrix which forms the polymer. When the suspension is treated at temperatures lower than the glass transition temperature of the polymer by 10° C., the polymer particles crushed, rather than deformed. On the other hand, when the suspension is treated at temperatures higher than the glass transition temperature of the polymer by 10° C., the polymer particles are apt to aggregate to each other to form a mass, but also the polymer particles become spherical again on account of surface tension even after the particles have been deformed, so that deformation efficiency is low. The treatment is carried out usually over a period of 0.5-10 hours, preferably 2-5 hours.

The use of an annular, continuous, wet type agitation mill has an advantage that the rotor produces a larger shearing force in the direction of rotation than a ball mill or a sand mill, and can exert anisotropic stress on the particles, so that they are effectively deformed even when they have a significant particle size distribution. Namely, the particles are deformed irrespectively of their diameters, so that the resultant toner particles have a greatly improved blade cleanability. In addition, such particles make contact with a substrate with a large surface area when transferred from a photoconductive body, and thus fixed thereon at relatively low temperatures. Similarly, the individual particles have a large contact area on a substrate, so that a small amount of such particles produces dark images, and consumption of toner is reduced.

As above set forth, there is obtained a disklike polymer particle having a diameter of 3-30 μm, a thickness of 1-15 μm and a flatness of not more than 0.5, or an oval polymer particle having a major axis 3-30 μm in length, a minor axis 1-25 μm in length and a flatness of not more than 0.5 according to the invention.

According to the invention, after the deformation of the particles as described hereinbefore, the polyvinyl alcohol used as a suspending agent in the stage of the suspension polymerization and deformation of the polymer particles is saponified.

In one method, the saponification of the polyvinyl alcohol may be carried out by adding a saponification agent to the suspension containing the polymer particles. In another method, the particles are separated from the suspension, and the particles may be treated with a saponification agent.

The saponification is carried out using an alkali or an acid. When an alkali is used, the amount thereof may be between about an equivalent to and about 1000 times as much as the equivalent of the vinyl acetate component contained in the polyvinyl alcohol used, and preferably in an amount of about 5-50 times the equivalent of the vinyl acetate component. However, the amount is not critical, and an amount less than the equivalent may satisfactorily saponify the polyvinyl alcohol used. If necessary, a minimum amount of the saponification agent required may be determined by a simple experiment well known in the chemistry of polyvinyl alcohol. The alkali used as a saponification agent includes, for example, sodium hydroxide and potassium hydroxide.

In a preferred embodiment, the saponification may be carried out as follows. An aqueous solution of a lower aliphatic alcohol, such as methanol, ethanol, propanol, among which methanol is most preferred, in amounts of about 1-50% by volume, preferably of about 5-30% by volume, containing an alkali, is added to a suspension containing the polymer particles, and the mixture is stirred at temperatures of about 30°-70° C. for about 1-10 hours, although these reaction conditions are not critical.

The use of a lower aliphatic alcohol, such as methanol, in the alkali saponification of the polyvinyl alcohol is advantageous in that the alcohol raises wettability of the polymer particles to water, thereby to carry out the saponification in a short period of time. Further, methanol in particular is used, the vinyl acetate unit in the polyvinyl alcohol reacts with methanol to produce methyl acetate by an ester exchange reaction, so that the saponification reaction proceeds rapidly.

After the saponification in this manner, in particular the polyvinyl alcohol remaining on the surface of the polymer particles, the polymer particles are separated, washed with water or preferably with an aqueous alcohol solution as previously mentioned, and then washed with an aqueous solution or an aqueous alcohol solution which contains an acid such as hydrochloric acid to neutralize the alkali used, and finally the particles are washed with water or an aqueous alcohol solution.

As the washing for the particles after the saponification is preferred an aqueous alcohol solution, and especially an aqueous methanol solution which contains methanol in amounts of about 1-50%, preferably of about 5-30% by volume. The washing for neutralizing the alkali contains an acid usually in amounts of equivalent at most to the amount of the alkali used in the saponification. The washing for the particles after the neutralization of alkalis is also preferably an aqueous alcohol solution, and especially an aqueous methanol solution which contains methanol in amounts of about 1-50%, preferably of about 5-30% by volume.

The saponification of the polyvinyl alcohol may be alternatively carried out using an acid. By way of example, an aqueous solution or preferably an aqueous alcohol solution as before described of an acid such as sulfuric acid or hydrochloric acid is added to a suspension of the polymer particles, stirred under heating, neutralized with an alkali, washed with water, and dried.

After the saponification of the polyvinyl alcohol, the polymer particles are dried, and if necessary classified, to provide a toner for use in electrophotography.

As above set out, carbon black and a charge controlling agent are minutely and evenly dispersed in a radical polymerizable monomer, the monomer is suspension polymerized to spherical polymer particles of 1-30 μm in diameter, the particles are deformed into disklike or oval particles, and then the polyvinyl alcohol remaining on the particles is removed therefrom by saponification and washing. Thus, the resultant toner is insensitive to humidity and has a high stability to change of ambient conditions. Further, the toner is deformed in shape so that it has an excellent blade cleanability and is readily fixed on a substrate at a relatively low temperature.

Dispersion of carbon black and a charge controlling agent into a radical polymerizable monomer, polymerization of such a monomer composition containing the carbon black and charge controlling agent in the presence of polyvinyl alcohol as a suspending agent, and saponification of the polyvinyl alcohol is substantially the same throughout herein the specification. Therefore, such description may be omitted occasionally hereinafter if invention is not rendered unclear.

PART B

Production of Deformed Toners by Mechanical Pressing

Further according to the invention, there is provided a method of producing a deformed toner which is improved in triboelectricity as well as blade cleanability.

The method of the invention comprises making finely divided triboelectric or electroconductive particles or both adhere onto spherical polymer particles which have been produced by suspension polymerization as set forth hereinbefore, mechanically pressing the polymer particles at temperatures smaller than the glass transition temperature of the polymer to deform the polymer particles into particles having a deforming ratio of not more than 0.95 as well as to fix the triboelectric and/or electroconductive particles on the polymer particles.

The deforming ratio is defined herein the specification as the ratio of the minor axis to the major ratio of the particles. Thus, the smaller the deforming ratio, the flatter the particles.

In a preferred embodiment, the toner is advantageously produced by a method comprising the following steps carried out in sequence:

(a) the step of dispersing carbon black and optionally a charge controlling agent minutely and uniformly both as finely divided particles of not more than 1 μm in particle size in a radical polymerizable liquid monomer;

(b) the step of adding an azobisnitrile polymerization initiator to the resultant monomer composition, suspending the composition in water containing polyvinyl alcohol as a suspending agent, suspension polymerizing the monomer to provide spherical polymer particles composed of a matrix of the polymer and the carbon black and charge controlling agent dispersed therein and having a diameter of 1-30 μm;

(c) the step of saponifying the polyvinyl alcohol, washing, recovering and drying the spherical polymer particles; and (d) the step of making finely divided triboelectric or electrocondictive particles or both adhere onto the spherical polymer particles, mechanically pressing the polymer particles at temperatures smaller than the glass transition temperature of the polymer forming the matrix of the particles to deform the polymer particles into particles having a deforming ratio of not more than 0.95 as well as to fix the triboelectric and/or electroconductive particles on the polymer particles.

In this method, there are used as the finely divided electroconductive particles, for example, at least one selected from the group consisting of powders of a metal, a metal oxide or carbon, while as the finely divided triboelectric particles, there is used such a charge controlling agent as described hereinbefore. Herein "triboelectric" is a synonym for "charge controlling". Either the triboelectric or the electroconductive particles used have preferably an average particle size of not more than 1 μm.

In accordance with the invention, the triboelectricity of toner particles may also be controlled by making the triboelectric or electroconductive particles adhere onto the surface of polymer particles after the deformation of the polymer particles, as will be hereinafter described. Therefore, in this method, the charge controlling agent is not necessarily incorporated into the monomer before the suspension polymerization. However, when desirable, carbon black is first dispersed in the monomer and then a charge controlling agent, in the same manner as set forth hereinbefore. The step of suspension polymerization and saponification of polyvinyl alcohol is the same as before.

The finely divided triboelectric or electroconductive particles are made to adhere onto the spherical polymer particles by mechanically mixing and agitating the former and the latter particles together under heating if necessary. There may be used as the electroconductive particles, for example, a powder of a metal such as iron, aluminum, copper or silver, electroconductive metal oxide such as titanium oxide, indium oxide or stannic oxide, carbonaceous material such as carbon black or graphite, with carbon black most preferred, having an average particle size of not more than about 1 μm, preferably of not more than 0.5 μm.

The polymer particles having the triboelectric or electroconductive particles or both adhering thereonto are mechanically pressed into deformed particles having the triboelectric or electroconductive particles or both fixed thereon by, for example, placing the particles in a layer and pressing the layer with a hydraulic press. A variety of methods may be employed in addition to the above. For example, a jet method wherein the polymer particles are made to collide with a hard plate at a high velocity; or a high rate rotation method wherein the polymer particles are rotation agitated at a high rate. The polymer particles are deformed by these mechanical treatment while the finely divided triboelectric or electroconductive particles are in part embedded in the polymer particles or made adhered firmly onto the particles, and thus are fixed thereon.

In the mechanical treatment as above mentioned, it is necessary that the polymer particles are mechanically pressed into deformed particles at temperatures of less than the glass transition temperature of the polymer. When the polymer particles are pressed at temperatures of more than the glass transition temperature, the polymer particles aggregate to each other and have a wide particle distribution. The resultant toner is inferior in fluidity and produces undesirable fog or background contamination on positive images.

It is further necessary that the polymer particles are deformed into particles having a deforming ratio of not more than 0.90. The smaller the ratio, the flatter the particles. The particles having a deforming ratio of not more than 0.9 are found greatly improved in blade cleanability. However, it is preferred that the deforming ratio is not less than 0.5. When the polymer particles are excessively deformed, the particles are inferior in fluidity and give undesirable effects upon the resultant positive images.

The resultant toner particles produced by the method have an optimum electrical charge used in an electrophotographic process because of the electroconductive particles fixed on the particles, and an ensured triboelectricity because of the triboelectric particles fixed on the particles, and thus have a very high copying performance.

In addition, while the triboelectric or electroconductive particles are fixed on the polymer particles, the polymer particles melt at least in part on the surface so that the polyvinyl alcohol remaining on the surface of the polymer particles, if any, are embedded therein, while the electroconductive (and triboelectric) particles form a hydrophobic surface on the polymer particles. Thus, the resultant toner is insensitive to humidity as well as highly fluid. It is a further advantage of the method that even when the electroconductive or triboelectric particles are inhibitive of polymerization of the monomer, as often is the case, the polymer particles can contain such particles.

The polymer particles thus prepared according to the invention have a fine and uniform particle size, and a high fluidity, so that the particles, as they are, may be used as a toner in an electrophotographic process, however, the particles may be admixed with a fluidizing agent such as hydrophobic silica so that they have a higher fluidity. The fluidizing agent may be used usually in an amount of about 0.05–1 parts, preferably of about 0.1–0.5 parts by weight, in relation to 100 parts by weight of the polymer particles.

PART C

Production of Toners by Methods Including Steps of Suspension Polymerization and Crushing Polymer Particles Still further in accordance with the invention, there is provided a method of producing a toner which comprises preparing polymer particles of 20–300 μm in diameter by such suspension polymerization as described hereinbefore, and then crushing and classifying the polymer particles into a desirable particle size.

More specifically, the method comprises the following steps carried out in sequence:

(a) the step of dispersing carbon black and a charge controlling agent minutely and uniformly both as finely divided particles of not more than 1 μm in particle size in a radical polymerizable liquid monomer;

(b) the step of adding an azobisnitrile polymerization initiator to the resultant monomer composition, suspending the composition in water containing polyvinyl alcohol as a suspending agent, and suspension polymerizing the monomer to provide spherical polymer particles having a diameter of 20–300 μm;

(c) the step of saponifying the polyvinyl alcohol; and (d) the step of recovering, washing and drying the polymer particles, and then crushing and classifying the polymer particles into formless or irregularly shaped particles of 1–30 μm in particle size.

This method has a feature in that spherical polymer particles of 20–300 μm in particle size are produced by suspension polymerization and the particles are crushed to formless particles, apart from a further feature of the saponification of the polyvinyl alcohol as described before. It is difficult to crush such polymer particles as smaller than 20 μm in particle size, and even after crushing operation most of the polymer particles remain spherical. Such spherical particles are inferior in blade cleanability, as hereinbefore set forth. It is likewise difficult to crush polymer particles larger than 300 μm to a desirable size but also much time is needed to crush such large particles to a desirable size.

Spherical polymer particles of 20–300 μm diameter are obtained by suitably adjusting the condition under which the monomer composition is dispersed as droplets in an aqueous medium, as generally known in the art.

A variety of crushing means may be employed to crush the polymer particles, such as an impact crusher, a jet crusher or a vortex crusher. The use of the vortex crusher is preferred since it enables the reduction of electric power consumption needed. For example, the power needed when a vortex crusher is used is 20–35% of the power needed when a jet mill is used.

Figure 3:
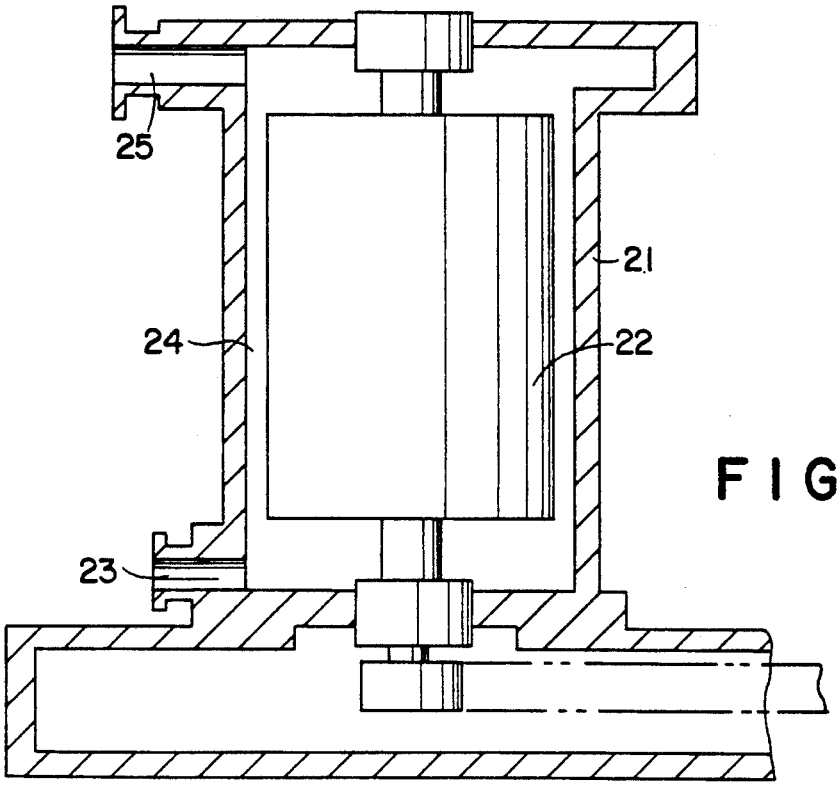
FIG. 3 is a sectional view of a vortex type mill preferably used for the production of deformed polymer particles according to an embodiment of the invention.

As shown in FIG. 3, the vortex type crusher is a vertical type, high rate rotation crusher. The crusher has a stator 21 and a rotor 22 therein which is usually provided annular or otherwise shaped grooves. The polymer particles are sucked into the stator together with air through a suction 23 provided with at the lower portion of the stator, and are made to collide with each other and crushed in a gap 24 between the rotor and the stator by an eddy produced there. The thus crushed polymer particles are then discharged from an outlet 25 at the upper portion of the stator together with air.

As already described with the foregoing methods of the invention, according to this method also, there is obtained a toner particle which is not only insensitive to ambient humidity. Further, the toner has particles of the charge controlling agents exposed on the surface. Thus, the toner of the invention has a high triboelectricity and the individual particles are evenly electrified when used in electrophotography, as well as the toner of the invention is formless or irregularly shaped so that it has an excellent blade cleanability.

PART D

Production of Deformed Toners by Methods Including Steps of Suspension Polymerization, Deforming and Then Crushing Polymer Particles Preferably, the polymer particles produced by suspension polymerization and having a diameter of 20–300 μm are at first deformed by mechanical impact given thereto, and then are saponified and crushed to formless particles of 1–30 μm in particle size.

More specifically, the method comprises the following steps carried out in sequence:

(a) the step of dispersing carbon black and a charge controlling agent minutely and uniformly both as finely divided particles of not more than 1 μm in particle size in a radical polymerizable liquid monomer;

(b) the step of adding an azobisnitrile polymerization initiator to the resultant monomer composition, suspending the composition in water containing polyvinyl alcohol as a suspending agent, and suspension polymerizing the monomer to provide spherical polymer particles having a diameter of 20–300 μm;

(c) the step of deforming the spherical polymer particles in the suspension by imparting mechanical impact thereto at temperatures in the range of ±10° C. of the glass transition temperature of the polymer in the presence of polyvinyl alcohol;

(d) the step of saponifying the polyvinyl alcohol; and (e) the step of recovering, washing and drying the polymer particles, and then crushing and classifying the polymer particles into formless or irregularly shaped particles of 1–30 μm in particle size.

According to this method, spherical polymer particles having a diameter of 20–300 μm are produced by suspension polymerization. The polymer particles have a deforming ratio usually of not less than 98%, as the deforming ratio has been hereinbefore described. The polymer particles are then deformed by applying thereto mechanical impact in the presence of polyvinyl alcohol at temperature in the range of ±10° C. of the glass transition temperature of the polymer. Thereafter the polyvinyl alcohol is saponified in the same manner as hereinbefore described, recovered, washed and dried, followed by crushing and classifying into formless particles of 1–30 μm in size, thereby to provide toner particles.

It is advantageous in the invention to impart mechanical impact to polymer particles in the suspension after the suspension polymerization has been carried out. Thus, a ball mill or a sand mill is preferably used for such a purpose.

It is necessary that treatment of the suspension containing the polymer particles is carried out at temperatures in the range of ±10° C. of the glass transition temperature of the matrix which forms the polymer. When the suspension is treated at temperatures lower than the glass transition temperature of the polymer by 10° C., the polymer particles are crushed, rather than deformed. On the other hand, when the suspension is treated at temperatures higher than the glass transition temperature of the polymer by 10° C., the polymer particles are apt to aggregate to each other to form mass, but also the polymer particles become spherical again on account of surface tension even after the particles have been deformed, so that deformation efficiency is low.

The deformation of the polymer particles is carried out so that the polymer particles have a deforming ratio of not more than 0.9, most preferably in the range of 0.5–0.9. The deformed polymer particles having a such deforming ratio are readily crushed.

Although not limited, the polymer particles in the suspension are treated over a period of 0.5–10 hours, more preferably of 2–5 hours.

The toner according to the method are formless so that it has an excellent blade cleanability.

PART E

Production of Toners by Methods Including A Step of Specific Treatment of Polymer Particles After Saponification of Polyvinyl Alcohol As hereinbefore set out, polyvinyl alcohol used as a suspending agent is saponified after the suspension polymerization so as to be hydrophilic, and is then removed from the polymer particles by washing with water. This method thus provides a toner particle which is insensitive to ambient humidity and stable in triboelectricity, and thus provides high quality toner images irrespectively of ambient circumstances.

However, when the polymer particles produced by suspension polymerization in the presence of polyvinyl alcohol as a suspending agent are washed with water, the polymer particles become hydrophobic as the saponified polyvinyl alcohol is removed from the surface of the polymer particles, and the particles become less dispersible in water to make the washing difficult. This is the reason why an aqueous methanol solution is desirably used, rather than water, as a washing for the polymer particles after the saponification of polyvinyl alcohol used. The use of methanol or its aqueous solution is thus desirable from technical standpoint, but the use is undesirable from the production costs of toners on one hand. Additionally, the use of methanol is attended by a problem of waste water treatment.

As a solution of such problems as above, there is provided an improvement in the method of producing a toner particle which contains the step of suspension polymerization of a monomer in the presene of polyvinyl alcohol and the step of saponification of the polyvinyl alcohol. The improvement comprises washing the polymer particles after being produced by suspension polymerization with water which contains a copolymer of a first hydrophobic monomer and a second monomer having carboxyl groups or its alkali salt, and then treating the polymer particles with an aqueous solution of a salt of a polyvalent metal.

It is necessary that the copolymer or its alkali salts are water soluble. The hydrophobic monomer is preferably a styrenic monomer, namely, styrene or its derivatives, such as o-methylstyrene, m-methylstyrene, p-methylstyrene or o-chlorostyrene, whereas the second monomer containing carboxyls may be exemplified by acrylic acid, methacrylic acid or maleic acid. These monomers may be used singly or as a mixture. There may be mentioned as a preferred copolymer, for example, styrene-acrylic acid copolymer, methylstyrene-maleic acid copolymer, chlorostyrene-maleic acid copolymer, styrene-methylstyrene-methacrylic acid copolymer, styrene-methylstyrene-maleic acid copolymer. As alkali salts may be used alkali metal salts such as sodium or potassium salt, or ammonium salt. These copolymers are used usually in excess to saturated adsorption (e.g., $5\times10^{-7}$ g/cm$^3$) of the polymer particles.

When the polymer particles are washed with an aqueous solution containing the copolymer, the polyvinyl alcohol remaining on the polymer particles is desorbed therefrom because of its hydrophilicity, and in turn the copolymer is adsorbed on the polymer particles with its an anion moiety, for example, acrylic acid residue when the copolymer is a styrene-acrylic acid copolymer, thereby to form a protective colloid on the polymer particles. As results, wettability of the polymer particles are retained, and the polymer particles as readily washed with water even after all the polyvinyl alcohol has been removed from the polymer particles.

The polyvalent metal salt used is preferably a halide or organic acid salt such as acetate of the I or II group metals of the Periodic Table. Thus, by way of example, there may be preferably used aluminum chloride, barium chloride, calcium chloride, magnesium chloride, strontium chloride, zinc chloride or mercuric acetate. These polyvalent metal salts react with the anion component of the copolymer adsorbed on the polymer particles to produce metal salt cross-linking, thereby to render the surface of the polymer particles hydrophobic. In addition, when a styrene-acrylic acid is, in particular, used as the copolymer, its metal salt has a negative anion moiety to increase negative triboelectricity of the polymer particles.

Taking a gel point of the copolymer adsorbed on the polymer particles into consideration, the amount of the polyvalent metal salt used is usually more than the amount necessary for the copolymer to reach the gel point. The gel point is described in, for example, "Acrylic Acid And Its Polymers" by E. Ohmori (K. K. Shokodo, Japan).

PART F

Production of Toners by Suspension Polymerization Using Monomer Composition Containing Polymer Dissolved Therein As hereinbefore described, there have been proposed a variety of methods of producing toner particles directly by suspension polymerization in which a radical polymerizable monomer is suspension polymerized in an aqueous phase in the presence of a suspending agent such as polyvinyl alcohol.

However, as accepted, the polymer particles produced by such suspension polymerization has a wide particle size distribution. In more detail, a monomer composition which contains carbon black or a charge controlling agent dispersed therein is emulsified in an aqueous medium and then suspension polymerization is carried out. In such a method, carbon black, charge controlling agent or fine droplets of monomers containing such additives are scattered throughout the aqueous medium when the monomer composition is dispersed in the aqueous medium under high rate agitation, thereby rendering the particle size distribution of the resultant polymer particles wide, and in particular, to produce polymer particles too small to use as toner particles, as well as undesirable large particles. Accordingly, it is necessary to classify the polymer particles so that the particles have a suitable distribution for use as toner particles.

Therefore, as a still important aspect of the invention, there is provided a further improvement in the method of producing a toner particle for use in electrophotography which comprises suspension polymerizing a radical polymerizable monomer composition which contains carbon black and a charge controlling agent therein in the presence of a water soluble polymer as a suspending agent, the improvement being that the monomer further contains a monomer-soluble polymer dissolved therein, the monomer-soluble polymer being such that it decreases interfacial tension between the monomer composition phase and the aqueous phase when being contained in the monomer composition phase.

Polyvinyl alcohol is especially preferred as the water soluble suspending agent, as used throughout the invention, whereas there may be used as the monomer soluble polymer, for example, polyvinyl acetate, partially saponified polyvinylacetate (preferably having a saponification degree of about 2–7 mole %), styrene-acrylic acid copolymer, ethyl acrylate-acrylic acid copolymer or polymethyl methacrylate, among these is preferred in particular styrene-maleic acid copolymer. Since these monomer-soluble copolymers decrease interfacial tension between the monomer composition phase and the aqueous phase when the monomer composition contains such a monomer-soluble polymer, the monomer composition can be emulsified with a small shearing rate. In accordance with the invention, the shearing rate may be not more than $3.0\times10^5$ sec.$^{-1}$. However, when the shearing rate is too small, the monomer composition is insufficiently emulsified in aqueous phase, so that it is necessary that the shearing rate is not less than $0.5\times10^5$ sec.$^{-1}$.

Usually the monomer soluble polymer is added together with a charge controlling agent to the monomer composition containing carbon black in the stage of preparation of a suspension of the monomer composition.

Since the emulsification of the monomer composition can be effected at a small shearing rate according to this method, neither carbon black, a charge controlling agent nor a monomer droplet containing these materials are not scattered throughout water as a suspension medium, so that the monomer composition droplets have a narrow particle size distribution in water, and provides polymer particles likewise having a narrow particle size distribution. It is generally accepted that polymer particles produced by suspension polymerization have substantially the same distribution of the monomer droplets in the suspension.

The method provides polymer particles of 5–20 μm in average particle size and in a narrow particle size distribution. Thus, the resultant polymer particles can be used as they are as toners without classification.

The toner according to the invention may be used either as a two-component toner, a nonmagnetic one-component toner, or a magnetic one-component toner. In the production of a magnetic toner, a magnetic powder is preferably mixed with and dispersed in the monomer with a suitable means such as a ball mill, and then the monomer is mixed with carbon black and optionally with a charge controlling agent, followed by suspension polymerization of the monomer in the manner as hereinbefore described. In the production of a magnetic toner, a ferrite or a magnetite is used in an amount of about 30–300 parts, preferably of about 30–100 parts by weight, in relation to 100 parts by weight of the monomer.

When the polymer particles are used as a toner in a two-component developing manner, the particles are mixed with a carrier material well known in the art to form a two-component toner. The carrier material usable includes, for example, an iron powder, a ferrite powder, a powder mixture of resins and magnetic substances, and a magnetite powder. In a two-component toner, the polymer particles are used usually in an amount of about 2–20% by weight, preferably of about 5–10% by weight of the toner.

EXAMPLES

The invention will now be described with reference to examples which relates to non-magnetic two-component toners, however, the invention is not limited thereto.

EXAMPLE PART A

Production of Deformed Toners Using Wet Agitation Mill

EXAMPLE 1

An amount of 5 parts by weight of carbon black "Diablack" (tradename) #52 (volatile matters 0.8%, pH 8.0, particle size 27 mμ, from Mitsubishi Kasei Kogyo K. K., Japan) and 1 part by weight of lauroyl peroxide were added to and mixed with 50 parts by weight of styrene in a ball mill for 30 minutes to preliminarily disperse the carbon black in the monomer. The mixture was then further agitated in an autoclave at 70° C. for 1 hour. In this monomer mixture with carbon black, the carbon black was found about 0.1 μm in particle size and there took no sedimentation in the dispersion.

An amount of 0.4 parts by weight of an ethylene-vinyl acetate copolymer "Soablene CH" (tradename, from Nippon Gosei Kagaku Kogyo K. K., Japan) as a dispersing agent and 1.0 part by weight of a negative charge controlling agent, a dyestuff named "Spiron Black TRH" (tradename, from Hodogaya Kagaku Kogyo K. K., Japan) were added to the dispersion, and stirred with a ball mill for 100 hours, to provide a monomer composition. After this dispersion procedure, the dyestuff powder was found of about 0.3 μm in particle size, and was found not to sediment in the dispersion.

To the resultant dispersion were then added 37 parts by weight of styrene, 13 parts by weight of 2-ethylhexyl acrylate, 0.2 parts by weight of divinylbenzene, 3 parts by weight of azobisdimethylvaleronitrile and 3 parts by weight of polypropylene wax as an anti-offset agent, to form a monomer composition of which components are shown in Table 1.

The monomer composition was then added to 300 parts by weight of water containing 3 parts by weight of polyvinyl alcohol (having an average polymerization degree of 1700 and a saponification degree of 80 mole %) as a suspending agent, and the mixture was agitated using a homogenizer (Model 610 from K. K. Nippon Seiki Seisakusho, Japan) at 6000 rpm to disperse the monomer composition in the water.

TABLE 1

| Monomer Composition Phase (parts by weight) | |
|---|---|
| Styrene | 87 |
| 2-Ethylhexyl acrylate | 13 |
| Divinylbenzene | 0.2 |
| Carbon black | 5.0 |
| Spiron Black TRH | 1.0 |
| Polypropylene wax | 3 |
| Azobisdimethylvaleronitrile | 3 |
| Aqueous Phase (parts by weight) | |
| Polyvinyl alcohol | 3 |
| Deionized water | 300 |

The resultant aqueous dispersion was stirred at 70° C. for 5 hours, and then at 90° C. for another 1 hour. The resultant spherical polymer particles were found to have a glass transition temperature of 63° C. The particle size distribution of the polymer particles is shown in the Table 2.

The suspension was then continuously fed into an continuous, annular, wet type agitation mill (Kobol Mill from Shinko Foudler K. K.), as an example of such a mill is shown in FIG. 1, and the polymer particles were deformed under the conditions of temperature, suspension travelling speed and rotor peripheral speed shown in the Table 2. Zirconia spherules of 0.75–1.0 mm in diameter were used as a milling medium. The charge rate of the medium in the milling zone was 70%.

A mixture of 77% by volume of water and 23% by volume of methanol containing sodium hydroxide in an amount of equivalents ten times the vinyl acetate component of the polyvinyl alcohol used was added to the suspension and stirred at 50° C. for 3 hours to saponify the polyvinyl alcohol.

The resultant deformed polymer particles were recovered and washed with water, and then with aqueous solution containing hydrochloric acid in an amount equivalent to the amount of sodium hydroxide used to neutralize the sodium hydroxide. The polymer particles were dried under reduced pressures to provide toner particles.

The flatness, triboelectric charge (blow-off method) and amount of reversely charged toner particles were determined. Further, blade cleanability, nip gap and toner consumption were measured by applying the toner to an electrostatic copying machine. The results are shown in the Table 2.

The shape, average size and flatness of toner particles were measured with randomly selected 50 particles on through electromicrophotographs. The triboelectric charge of the toner particles was measured by a blow-off method with a mixture of the particles and iron carrier powder with the latter in an amount of 5% by weight based on the mixture. The amount of reversely charged toner particles was determined by means of an electric charge distribution analyzer (from Hosokawa Micron K. K., Japan).

The blade cleanability was measured as follows. After 10000 times copying using an electrostatic copying machine Rheodry 4515 from Toshiba K. K., Japan, at normal temperature and normal humidity, the surface of the electroconductive body after the blade cleaning and toner images formed on paper were observed. In the table 2, the results are shown in three grades: A, electroconductive body was completely cleaned and toner images were of high quality; B, electroconductive body was partly uncleaned and toner images were partly contaminated; C, electroconductive body remained substantially uncleaned.

The nip gap is a measure of fixability of toners on a substrate, and the smaller the nip gap, the better the fixability. The nip gap was measured as follows. Using a fixability testing roll machine composed of a heat roll of polytetrafluoroethylene and a back-up roll of a silicone rubber and with varied nip gaps, toners were fixed on paper. In the Table 2 were given the values of nip gap where toners were fixed at a fixing rate of not less than 90%. The fixability of toners was measured by change in darkness when toner images were rubbed after a predetermined time passed since the toners had been fixed.

The toner consumption was measured as follows. Using an LED printer K-II from Japan Kenteck K. K. with a surface electric potential adjusted so as to provide toner images having a darkness of 1.2, 1000 sheets of copies were made, and the power consumption by that time was measured.

EXAMPLE 2

The suspension prepared in the Example 1 was treated with the same agitation mill as in the Example 1 under the conditions shown in the Table 2, and otherwise in the same manner, toner particles were produced. The results are shown in the Table 2.

Comparative Example 1–6

With or without saponification and deformation treatment of polymer particles as designated in the Table 2, toner particles were produced. The results are shown in the Table 2.

TABLE 2

| | Examples | | Comparative Example | | | | | |
|---|---|---|---|---|---|---|---|---|
| | 1 | 2 | 1 | 2 | 3 | 4 | 5 | 6 |
| Saponification | Yes | Yes | No | Yes | Yes | No | No | No |
| Polymer Particles | | | | | | | | |
| Average size (μm) | 12.1 | 12.1 | 12.1 | 12.1 | 12.1 | 12.1 | 12.1 | 12.1 |
| Below 5 μm (vol. %) | 0.3 | 0.3 | 0.3 | 0.3 | 0.3 | 0.3 | 0.3 | 0.3 |
| 5–20 μm (vol. %) | 97.2 | 97.2 | 97.2 | 97.2 | 97.2 | 97.2 | 97.2 | 97.2 |
| Over 20 μm (vol. %) | 2.5 | 2.5 | 2.5 | 2.5 | 2.5 | 2.5 | 2.5 | 2.5 |
| Deformation | Yes | Yes | No | Yes | Yes*) | Yes | Yes | Yes |
| Deformation Conditions | | | | | | | | |
| Temperature (°C.) | 65 | 68 | — | — | 65 | 65 | 75 | 50 |
| Peripheral speed of rotor (m/min.) | 13 | 20 | — | — | — | 13 | 13 | 13 |
| Average stay time (min.) | 15 | 15 | — | — | — | 15 | 15 | 15 |
| Form of Toner | disk | oval | spherical | spherical | oval | disk | oval | disk |
| Average diameter (μm) | 13 | major 15 minor 10 | 12 | 12 | 13 | 13 | 15 | 10 |
| Average thickness (μm) | 6 | 5 | 12 | 12 | 10 | 6 | 7 | 4 |
| Properties of Toners | | | | | | | | |
| Electric charge (μC/g) | −29 | −28 | −18 | −29 | −28 | −17 | −16 | −19 |
| Reversely charged toners (wt. %) | 7 | 5 | 22 | 6 | 6 | 23 | 21 | 24 |
| Blade cleanability | | | | | | | | |
| Initial | A | A | C | A | A | A | C | A |
| After copying 10000 sheets | A | A | C | A | B | A | C | A |
| Nip gap | 1.5 | 1.5 | 2.5 | 2.5 | 2.0 | 1.5 | 1.5 | 1.5 |
| Toner consuption (mg/sheet) | 46 | 45 | 96 | 53 | 51 | 98 | 102 | 96 |

Notes *)Deformed with a batchwise, horizontal agitation mill.

EXAMPLE PART B

Production of Deformed Toners by Mechanical Pressing

EXAMPLE 1

To the same monomer mixture as that in the Example 1 of PART A were added 0.1 part by weight of an ethylene-vinyl acetate copolymer "Soablene CH" as a dispersing agent and 0.1 part by weight of "Spiron Black TRH", followed by stirring with a ball mill for 100 hours, to disperse the dyestuff in the dispersion.

To the resultant dispersion were then added 37 parts by weight of styrene, 13 parts by weight of 2-ethylhexyl acrylate, 0.2 parts by weight of divinylbenzene, 3 parts by weight of azobisdimethylvaleronitrile and 3 parts by weight of polypropylene was as an anti-offset agent, to form a monomer composition.

The monomer composition was added to 500 parts by weight of water containing 5 parts by weight of polyvinyl alcohol (having an average polymerization degree of 1700 and a saponification degree of 88 mole %) as a suspending agent. The mixture was agitated using a homogenizer (Model 610 from K. K. Nippon Seiki Seisakusho, Japan) at 15000 rpm to disperse the monomer in the water.

The resultant aqueous dispersion was stirred at 70° C. for 5 hours, and then at 90° C. for another 1 hour to provide a suspension of spherical polymer particles having a glass transition temperature of 65° C.

A mixture of 77% by volume of water and 23% by volume of methanol containing sodium hydroxide in an amount equivalent to the amount of the vinyl acetate component of the polyvinyl alcohol used was added to the suspension and stirred at 40° C. for 3 hours to saponify the polyvinyl alcohol.

The resultant deformed polymer particles were recovered and washed with water, and then with aqueous solution containing hydrochloric acid in an amount equivalent to the amount of sodium hydroxide used to neutralize the sodium hydroxide. The polymer particles were dried under reduced pressures.

An amount of 100 parts by weight of the polymer particles were mixed with 0.3 parts by weight of a dyestuff "Kayaset T-2N" (from Nippon Kayaku K. K.) as a charge controlling agent and agitated with an effective mixer to make the dyestuff particles adhere to the polymer particles evenly. The polymer particles were then pressed with a hydraulic press at a pressure of 300 kg/cm$^2$ at room temperatures to deform the polymer particles and crushed to provide toner particles.

EXAMPLE 2

An amount of 100 parts by weight of the same polymer particles as those in the Example 1 produced by suspension polymerization were mixed with 0.3 parts by weight of "Kayaset T-2N" and agitated with an effective a mixer to make the dyestuff particles to adhere to the polymer particles evenly. The polymer particles were then pressed with a hydraulic press at a pressure of 200 kg/cm$^2$ at 40° C. to deform the polymer particles and crushed to provide toner particles.

Comparative Example 1

The same polymer particles as those in the Example 1 produced by suspension polymerization were pressed at a pressure of 200 kg/cm$^2$ at 40° C. without the dyestuff. The deformed polymer particles were crushed to provide toner particles.

Comparative Example 2

The polymer particles before mixing with the dyestuff in the Example 1 is taken as a toner of this comparative example.

The average particle size, deforming rate, blade cleanability, triboelectric charge (blow-off method), rate of reverse charge particles and half value width of the toner particles are shown in the Table 3.

As will be apparent, the toner of Comparative Example 2 is inferior in blade cleanability and excess in charge, but also large in reverse charge. The toner of Comparative Example 1 is similar to the above, and in addition large in half value width and wide in charge distribution, although it is improved in blade cleanability to an extent.

The toner of the invention, on the contrary, is found to have an excellent in blade cleanability, a suitable charge with a narrow distribution and a small amount of reverse charge.

Figure 2:
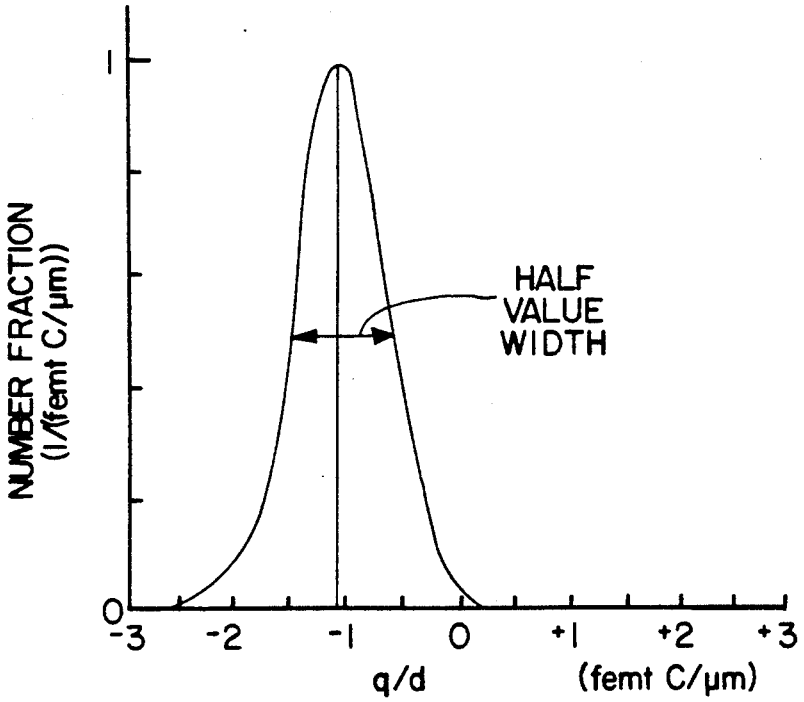
FIG. 2 illustrates the half value width of toner particles in general.

The average size of the toner particles were measured with a Coulter Counter TA-II from Coulter Electronics Inc. The half value breadth was measured based on q/d (femtC/μm) vs. number fraction (1/femtC/μm) of silica treated toners mixed with 5% by weight of an iron powder carrier, wherein q designates charges of individual toner particles and d designates diameters of toner particles, as an example of the relationship between the q/d and number fraction is illustrated in FIG. 2. The other measurements were described hereinbefore.

TABLE 3

| | Examples | | Comparative Examples | |
|---|---|---|---|---|
| | 1 | 2 | 1 | 2 |
| Fixing of Triboelectric Particles[1)] | | | | |
| Amount of particles[2)] | 0.3 | 0.3 | — | — |
| Fixing Conditions[3)] | | | | |
| Temperature (°C.) | RT[4)] | 40 | 40 | — |
| Pressure (Kg/cm$^2$) | 300 | 200 | 200 | — |
| Properties of Toners | | | | |
| Average size (μm) | 12.3 | 12.7 | 12.5 | 12.1 |
| Deforming rate | 0.8 | 0.8 | 0.8 | 1.0 |
| Blade cleanability | A | A | A | X |
| Electric charge (μC/g) | −29 | −29 | −39 | −44 |
| Reversely charged toners (wt. %) | 7 | 6 | 16 | 17 |
| Half value breadth (femtC/μm) | 1.0 | 0.9 | 1.2 | 1.3 |

Notes:
[1)]Dyestuff "Kayaset Black T-2N from Nippon Kayaku K.K.
[2)]Parts by weight to 100 parts by weight of polymer particles.
[3)]Triboelectric particles were fixed using a hydraulic press.
[4)]Room temperature

EXAMPLE PART C

Production of Toners by Methods Including Steps of Suspension Polymerization and Crushing Polymer Particles

EXAMPLE 1

An amount of 2.5 parts by weight of carbon black "Diablack" (tradename) #52, 2.5 parts by weight of Ketchen black and 1 part by weight of lauroyl peroxide were added to and mixed with 50 parts by weight of styrene in a ball mill for 30 minutes to preliminarily disperse the carbon black in the monomer. The mixture was then further agitated in an autoclave at 70° C. for 1 hour. In this monomer mixture with carbon black, the carbon black was found about 0.1 μm in particle size and there took no sedimentation in the dispersion.

To the monomer mixture were added 0.4 parts by weight of the ethylene-vinyl acetate copolymer "Soablene CH" and 1.0 part by weight of a dyestuff, "Spiron Black TRH", followed by stirring with a ball mill for 100 hours, to disperse the dyestuff in the dispersion, to provide a monomer composition. The dyestuff was found 0.3 μm in particle size and no sedimentation was observed.

To the resultant dispersion were then added 37 parts by weight of styrene, 13 parts by weight of 2-ethylhexyl acrylate, 0.2 parts by weight of divinylbenzene, 3 parts by weight of azobisdimethylvaleronitrile and 3 parts by weight of polypropylene wax as an anti-offset agent, to form a monomer composition.

The monomer composition was then added to 500 parts by weight of water containing 5 parts by weight of polyvinyl alcohol (having an average polymerization degree of 1700 and a saponification degree of 88 mole %) as a suspending agent, and the mixture was agitated using a homogenizer (Model 610 from K. K. Nippon Seiki Seisakusho, Japan) at 3000 rpm to disperse the monomer in the water.

The resultant aqueous dispersion was stirred at 70° C. for 5 hours, and then at 90° C. for another 1 hour to provide a suspension of spherical polymer particles.

A mixture of 77% by volume of water and 23% by volume of methanol containing sodium hydroxide in an amount of equivalents ten times the vinyl acetate component of the polyvinyl alcohol used was added to the suspension and stirred at 70° C. for 3 hours to saponify the polyvinyl alcohol.

The resultant polymer particles were separated from the dispersion, washed with water, and then with aqueous solution containing hydrochloric acid in an amount equivalent to the amount of sodium hydroxide used to neutralize the sodium hydroxide. The polymer particles were dried under reduced pressures. The size distribution of the particles are shown in the Table 4.

The polymer particles were crushed to toner particles of 1-30 μm with a vortex crusher (Cryptron, crushing ability of 60 Kg/hr, from Kawasaki Jukogyo K. K.), as shown in FIG. 3.

The average particle size, triboelectric charge (blow-off method) and rate of reversely charged toner particles were measured. Further, the toner was applied to an electrostatic copying machine (Model 1102Z from Sanyo Denki K. K., Japan) at normal temperature (20° C.) and normal relative humidity (60%) and at higher temperature (30° C.) and higher relative humidity (80%), respectively. The results are shown in the Table 4 together with electric power consumption needed to produce the toners.

In the Table 4, the background contamination was designated in four grades: A; none, B; slightly, C; significantly, D: much.

TABLE 4

| | Example | Comparative Examples | | | |
|---|---|---|---|---|---|
| | 1 | 1 | 2 | 3 | 4 |
| Size Distribution (wt. %) | | | | | |
| Below 20 μm | 2 | 2 | 2 | 2 | 2 |
| 20-300 μm | 95 | 95 | 95 | 95 | 95 |
| Over 300 μm | 3 | 3 | 3 | 3 | 3 |

TABLE 4-continued

| | Example | Comparative Examples | | | |
|---|---|---|---|---|---|
| | 1 | 1 | 2 | 3 | 4 |
| Type of Crushers | vortex | vortex | vortex | vortex | jet |
| Crushing Ability (Kg/hr) | 60 | 60 | 60 | 60 | 20 |
| Power Consumption (kwh) | 40 | 40 | 40 | 40 | 80 |
| Properties of Toners | | | | | |
| Electric charge (μC/g) | −23 | −7 | −23 | −38 | −24 |
| Reversely charged toners (wt. %) | 3.8 | 36 | 24 | 16 | 4.2 |
| Background contamination | | | | | |
| 20° C., 60% RH | A | C | B | C | A |
| 30° C., 80% RH | B | D | C | C | B |
| Blade cleanability | A | A | A | A | A |

COMPARATIVE EXAMPLE 1

Carbon black was dispersed in styrene in the absence of lauroyl peroxide and the dyestuff was dispersed in the monomer in the absence of the dispersing agent, and in addition, saponification of polyvinyl alcohol was not effected, but otherwise in the same manner as in the Example 1, spherical polymer particles were produced. The particle size distribution is shown in the Table 4.

The polymer particles were then crushed in the same manner as in the Example 1 to provide toner particles. The properties of the toner are shown in the Table 4.

COMPARATIVE EXAMPLE 2

Saponification of polyvinyl alcohol was not effected, but otherwise in the same manner as in the Example 1, spherical polymer particles were produced. The particle size distribution is shown in the Table 4.

The polymer particles were then crushed in the same manner as in the Example 1 to provide toner particles. The properties of the toner are shown in the Table 4.

COMPARATIVE EXAMPLE 3

Carbon black was dispersed in styrene in the absence of lauroyl peroxide and the dyestuff was dispersed in the monomer in the absence of the dispersing agent, but otherwise in the same manner as in the Example 1, spherical polymer particles were produced. The particle size distribution is shown in the Table 4.

The polymer particles were then crushed in the same manner as in the Example 1 to provide toner particles. The properties of the toner are shown in the Table 4.

COMPARATIVE EXAMPLE 4

A jet mill was used in place of the vortex crusher (milling ability of 20 Kg/hr) and otherwise in the same manner as in the Example 1, toner particles were produced. The properties of the toner are shown in the Table 4 together with electric power consumption needed to produce the toners.

EXAMPLE PART D

Production of Deformed Toners by Methods Including Steps of Suspension Polymerization, Deforming and Then Crushing Polymer Particles

EXAMPLE 1

In the same manner as in the Example 1 of PART C, spherical polymer particles having a glass transition temperature of 65.0° C. were produced.

The polymer particles were deformed with a ball mill at 150 rpm either at 55° C., 65° C. or 75° C. using glass beads of 5 mm in diameter, followed by saponification of the polyvinyl alcohol and washing the polymer particles in the same manner as in the Example 1 of PART C. The deformed polymer particles were dried under a reduced pressure and then crushed into toner particles of 1-30 μm in size.

When the deformation of the polymer particles was carried out at 55° C., the polymer particles were crushed rather than deformed, whereas when the deformation was carried out at 75° C., some portions of the polymer particles adhered to each other to form a mass, and some portions of the polymer particles turned spherical again after being once deformed, so that deformation efficiency was found low.

Therefore, the properties of toner particles deformed at 65° C. were shown in the Table 5.

TABLE 5

| | Example | Comparative Examples | | | |
|---|---|---|---|---|---|
| | 1 | 1 | 2 | 3 | 4 |
| Size Distribution (wt. %) | | | | | |
| Below 20 μm | 25 | 25 | 25 | 25 | 25 |
| 20-300 μm | 75 | 75 | 75 | 75 | 75 |
| Over 300 μm | 0 | 0 | 0 | 0 | 0 |
| Crushing of Polymer Particles | | | | | |
| Crushing ability (Kg/hr) | 35 | 30 | 30 | 35 | 35 |
| Power Consumption (kwh) | 85 | 90 | 90 | 85 | 85 |
| Properties of Toners | | | | | |
| Electric charge (μC/g) | −24 | −8 | −23 | −20 | −36 |
| Reversely charged toners (wt. %) | 4.2 | 37 | 3.9 | 22 | 14 |
| Background contamination | | | | | |
| 20° C., 60% RH | A | C | A | B | C |
| 30° C., 80% RH | B | D | B | C | C |
| Blade cleanability | A | C | C | A | A |

Comparative Example 1

Carbon black was dispersed in styrene in the absence of lauroyl peroxide and the dyestuff was dispersed in the monomer in the absence of the dispersing agent, and in addition, neither the deformation of the resultant spherical polymer particles nor the saponification of polyvinyl alcohol were effected, but otherwise in the same manner as in the Example 1, spherical polymer particles were produced. The particle size distribution is shown in the Table 5.

The polymer particles were then crushed in the same manner as in the Example 1 to provide toner particles. The properties of the toner are shown in the Table 5.

Comparative Example 2

The spherical polymer particles were produced by suspension polymerization in the same manner as in the Example 1, but the resultant polymer particles were not deformed. The particle size distribution is shown in the Table 5.

The polymer particles were then crushed in the same manner as in the Example 1 to provide toner particles. The properties of the toner are shown in the Table 5.

Comparative Example 3

Saponification of polyvinyl alcohol was not effected, but otherwise in the same manner as in the Example 1, spherical polymer particles were produced. The particle size distribution before deformation is shown in the Table 5.

The polymer particles were then crushed in the same manner as in the Example 1 to provide toner particles. The properties of the toner are shown in the Table 5.

Comparative Example 4

Carbon black was dispersed in styrene in the absence of lauroyl peroxide and the dyestuff was dispersed in the monomer in the absence of the dispersing agent, but otherwise in the same manner as in the Example 1, spherical polymer particles were produced. The particle size distribution before the deformation is shown in the Table 5.

The polymer particles were then crushed in the same manner as in the Example 1 to provide toner particles. The properties of the toner are shown in the Table 5.

In the Table 5, the background contamination of toner images are designated in four grades: A, none; B, slightly observed; C, significantly observed; D, much.

EXAMPLE PART E

Production of Toners by Methods Including A Step of Specific Treatment of Polymer Particles After Saponification of Polyvinyl Alcohol

EXAMPLE 1

An amount of 5 parts by weight of carbon black "Diablack" (tradename) #52 (volatile matters 0.8%, pH 8.0, particle size 27 μm, from Mitsubishi Kasei Kogyo K. K., Japan) and 1 part by weight of lauroyl peroxide were added to and mixed with 50 parts by weight of styrene in a ball mill for 30 minutes to preliminarily disperse the carbon black in the monomer. The mixture was then further agitated in an autoclave at 70° C. for 1 hour. In this monomer mixture with carbon black, the carbon black was found about 0.1 μm in particle size and there took no sedimentation in the dispersion.

An amount of 0.4 parts by weight of an ethylene-vinyl acetate copolymer "Soablene CH" (tradename, from Nippon Gosei Kagaku Kogyo K. K., Japan) as a dispersing agent and 1.0 part by weight of a negative charge controlling agent, a dyestuff named "Spiron Black TRH" (tradename, from Hodogaya Kagaku Kogyo K. K., Japan) were added to the dispersion, and stirred with a ball mill for 100 hours, to provide a monomer composition. After this dispersion procedure, the dyestuff powder was found of about 0.3 μm in particle size, and was found not to sediment in the dispersion.

to the resultant dispersion were then added 37 parts by weight of styrene, 13 parts by weight of 2-ethylhexyl acrylate, 0.2 parts by weight of divinylbenzene, 3 parts by weight of azobisdimethylvaleronitrile and 3 parts by weight of polypropylene wax as an anti-offset agent, to form a monomer composition.

The monomer composition was then added to 500 parts by weight of water containing 5 parts by weight of polyvinyl alcohol (having an average polymerization degree of 1700 and a saponification degree of 80 mole %) as a suspending agent, and the mixture was agitated using a homogenizer (Model 610 from K. K. Nippon Seiki Seisakusho, Japan) at 5000 rpm to disperse the monomer in the water.

The resultant aqueous dispersion was stirred at 70° C. for 5 hours, and then at 90° C. for another 1 hour, to provide spherical polymer particles.

To the suspension of the polymer particles were added a mixture of 77% by volume of water and 23% by volume of methanol containing sodium hydroxide in an amount of equivalents 50 times the vinyl acetate component of the polyvinyl alcohol used, and the mixture was stirred at 50° C. for 3 hours to saponify the polyvinyl alcohol.

The polymer particles were separated, washed with water, and then with aqueous solution containing hydrochloric acid in an amount equivalent to the amount of sodium hydroxide used to neutralize the sodium hydroxide until the pH of the washing became neutral.

The polymer particles were then again dispersed in water. To the resultant dispersion of the polymer particles was added an aqueous solution containing 0.5 g of ammonium salt (having a neutralizing degree of 0.5) of a styrene-acrylic acid copolymer (having a molar ratio of styrene/acrylic acid of 17/83) and the polymer particles were washed with the solution.

There was added to the resultant dispersion of the polymer particles, 0.06 g of aluminum chloride, to metal-crosslink the styrene-acrylic acid copolymer, thereby to render the surface of the polymer particles hydrophobic. The polymer particles were then centrifuged, dried at 40° C. under reduced pressures for 24 hours, and crushed to provide toner particles.

EXAMPLE 2

An amount of 0.22 g of barium chloride was used in place of aluminum chloride, and otherwise in the same manner as in the Example 1, toner particles were produced.

Comparative Example 1

In the same manner as in the Example 1, polymer particles were produced by suspension polymerization and the polyvinyl alcohol was saponified.

The polymer particles were then washed with a mixture of 77% by volume of water and 23% by volume of methanol, and then with a mixture of 77% by volume of water and 23% by volume of methanol containing hydrochloric acid in an amount of equivalent to the sodium hydroxide used. Thereafter the polymer particles were washed again with a mixture of 77% by volume of water and 23% by volume of methanol.

The polymer particles were then centrifuged, dried at 40° C. under reduced pressures for 24 hours, and crushed to provide toner particles.

Comparative Example 2

In the same manner as in the Example 1, polymer particles were produced by suspension polymerization and the polyvinyl alcohol was saponified.

The polymer particles were then washed with water, and then with an aqueous solution of hydrochloric acid in an amount of equivalent to the sodium hydroxide used for the saponification, followed by washing with water again.

The polymer particles were then centrifuged, dried at 40° C. under reduced pressures for 24 hours, and crushed to provide toner particles.

Comparative Example 3

In the same manner as in the Example 1, polymer particles were produced by suspension polymerization in the presence of polyvinyl alcohol.

Without saponification of the polyvinyl alcohol, the resultant polymer particles were washed with water and then centrifuged, followed by drying at 40° C. under reduced pressures for 24 hours and crushing to toner particles.

The average particle size, triboelectric charge (blow-off method), rate of reversely charged toners, hydrophobicity of toners and copying performance were measured.

The above results are shown in the Table 6.

As will be apparent from the results in the Table 6, the toner of the Comparative Example 1 produces a large amount of reversely charged toners. The toner of the Comparative Example 2 produces a larger amount of reversely charged toners, but also produces toner images having fog thereon under high humidity conditions. The toner of the Comparative Example 3 is much inferior in properties to the toner of the Comparative Example 2. Contrary to these toners, the toner of the invention produces only a slight amount of reversely charged particles, but also the toner is stable to ambient conditions.

TABLE 6

| | Examples | | Comparative Examples | | |
|---|---|---|---|---|---|
| | 1 | 2 | 1 | 2 | 3 |
| Properties of Toners | | | | | |
| Average size (μm) | 11.9 | 12.0 | 12.1 | 12.1 | 11.1 |
| Surface hydrophobicity[1)] | 63/35 | 65/35 | 65/35 | 70/30 | 80/20 |
| Electric charge (μC/g) | −23 | −25 | −26 | −18 | −7 |
| Reversely charged toners (wt. %) | 4 | 3 | 9 | 15 | 31 |
| Copying Performance[2)] | | | | | |
| 20° C., 60% RH | | | | | |
| Fog | slightly | slightly | slightly | slightly | fairly |
| Darkness | 1.3 | 1.2 | 1.2 | 1.0 | 0.9 |
| 30° C., 80% RH | | | | | |
| Fog | slightly | slightly | slightly | fairly | much |
| Darkness | 1.2 | 1.2 | 1.1 | 0.8 | 0.6 |

Notes:
[1)]The surface hydrophobicity was estimated in terms of a maximum water/methanol volume ratio of an aqueous solution of methanol with which the particles got completely wetted. The smaller the ratio, the higher the hydrophobicity.
[2)]Toners were applied to an electrostatic copying machine Model 1102Z from Sanyo Denki K.K.

EXAMPLE PART F

Production of Toners by Suspension Polymerization Using Monomer Composition Containing Polymer Dissolved Therein

EXAMPLE 1

An amount of 2.5 parts by weight of carbon black "Diablack" (tradename) #52, 2.5 parts by weight of Ketchen black and 1 part by weight of lauroyl peroxide were added to and mixed with 50 parts by weight of styrene in a ball mill for 30 minutes to preliminarily disperse the carbon black in the monomer. The mixture was then further agitated in an autoclave at 70° C. for 1 hour. In this monomer mixture with carbon black, the carbon black was found about 0.1 μm in particle size and there took no sedimentation in the dispersion.

To the monomer mixture were added 0.5 parts by weight of a partially saponified polyvinyl acatate (having a saponification degree of 5 mole %, soluble in the monomer) in an amount of 0.5% by weight of the monomer, and then 1.0 part by weight of a dyestuff, "Spiron Black TRH", followed by stirring with a ball mill for 100 hours, to disperse the dyestuff in the dispersion, to provide a monomer composition. The dyestuff was found 0.3 μm in particle size and no sedimentation was observed.

To the resultant dispersion were then added 37 parts by weight of styrene, 13 parts by weight of 2-ethylhexyl acrylate, 0.2 parts by weight of divinylbenzene, 3 parts by weight of azobisdimethylvaleronitrile and 3 parts by weight of polypropylene wax as an anti-offset agent, to form a monomer composition.

The monomer composition was then added to 300 parts by weight of water containing 3 parts by weight of polyvinyl alcohol (having an average polymerization degree of 1700 and a saponification degree of 80 mole %) as a suspending agent, and the mixture was agitated using a homogenizer (Model 610 from K. K. Nippon Seiki Seisakusho, Japan) at 3000 rpm to disperse the monomer in the water. The rotation rate of the homogenizer corresponded to a shearing rate of $1.7\times10^5$ second$^{-1}$, as will be described.

The resultant aqueous dispersion was stirred at 70° C. for 5 hours, and then at 90° C. for another 1 hour to provide a suspension of spherical polymer particles.

A mixture of 77% by volume of water and 23% by volume of methanol containing sodium hydroxide in an amount of equivalents ten times the vinyl acetate component of the polyvinyl alcohol used was added to the suspension and stirred at 70° C. for 3 hours to saponify the polyvinyl alcohol.

The resultant polymer particles were separated from the dispersion, washed with water, and then with aqueous solution containing hydrochloric acid in an amount equivalent to the amount of sodium hydroxide used to neutralize the sodium hydroxide. The polymer particles were dried under reduced pressures, to provide toner particles. The average size of the toner particles and their copying performance are shown in the Table 7.

The interfacial tension between the monomer phase containing a polymer dissolved therein and the aqueous phase containing polyvinyl alcohol dissolved therein is shown in the Table 7.

EXAMPLE 2

A styrene-acrylic acid copolymer (having a molar ratio of styrene/acrylic acid of 92/8) was used and the homogenizer was operated at a rate of 3500 rpm (i.e., at a shearing rate of $2.0\times10^5$ second$^{-1}$), and further the pH of the aqueous phase was adjusted at 10 so that the acrylic acid component of the styrene-acrylic acid copolymer was dissociative and the copolymer had an increased ability as a surfactant, but otherwise in the same manner as in the Example 1, toner particles were produced.

The size distribution of the toner particles and the copying performance are shown in the Table 7.

Comparative Example 1

No monomer-soluble polymer was used when a charge controlling agent was dispersed in the monomer and the homogenizer was operated at a rotation rate of 7000 rpm (i.e., a shearing rate of $4.1\times10^5$ second$^{-1}$), but otherwise in the same manner as in the Example 1, toner particles were produced.

The size distribution of the toner particles and the copying performance are shown in the Table 7, together with the interfacial tension between the monomer phase and the aqueous phase.

Comparative Example 2

No monomer-soluble polymer was used when a charge controlling agent was dispersed in the monomer and the homogenizer was operated at a rotation rate of 12000 rpm (i.e., a shearing rate of $7.0\times10^5$ second$^{-1}$), while as a suspending agent polyvinyl alcohol (having an average polymerization degree of 1700 and a saponification degree of 80 mole %) was used, but otherwise in the same manner as in the Example 1, toner particles were produced.

The size distribution of the toner particles and the copying performance are shown in the Table 7, together with the interfacial tension between the monomer phase and the aqueous phase.

TABLE 7

| | Examples | | Comparative Examples | | |
|---|---|---|---|---|---|
| | 1 | 2 | 1 | 2 | 3 |
| Suspension Polymerization | | | | | |
| Monomer soluble polymers[1)] | a | b | none | none | a |
| Amount of the polymers[2)] | 0.5 | 0.5 | — | — | 0.5 |
| Suspending agent | c | c | c | d | c |
| Amount of the agent[3)] | 1.0 | 1.0 | 1.0 | 1.0 | 1.0 |
| Interfacial tension (dyne/cm) | 5.0 | 5.1 | 7.1 | 14.4 | 5.0 |
| Rotation rate of homogenizer | 3000 | 3500 | 7000 | 12000 | 3000 |
| Shearing rate (second$^{-1}$) | $1.7\times10^5$ | $2.0\times10^5$ | $4.1\times10^5$ | $7.0\times10^5$ | $1.7\times10^5$ |
| Homogenized time (min.) | 60 | 60 | 60 | 10 | 60 |
| Saponification | Yes | Yes | Yes | Yes | No |
| Properties of Toners | | | | | |
| Average size (μm) | 11.9 | 11.9 | 12.0 | 11.8 | 11.9 |
| RAT ($R_{40}/R_{90}$) | 1.6 | 1.6 | 1.7 | 2.0 | 1.6 |
| Toners below 5 μm in diameter (wt. %) | 0.2 | 0.3 | 1.8 | 3.9 | 0.2 |
| Toners over 20 μm in diameter (wt. %) | 0.6 | 0.5 | 1.2 | 2.9 | 0.5 |
| Electric charge (μC/g) | −26 | −28 | −30 | −31 | −11 |
| Reversely charged toners (wt. %) | 4 | 3 | 7 | 9 | 28 |
| Scattered toners | neglectable | neglectable | slightly | slightly | much |
| Copying performance | | | | | |
| Fog | sligthly | slightly | slightly | fairly | much |
| Darkness of images | 1.3 | 1.2 | 1.1 | 1.0 | 0.7 |

Notes:
[1)]a: 5 mole % saponified polyvinyl acetate; b: styrene-acrylic acid compolymer having a molar ratio of styrene to acrylic acid of 92/8.
[2)]% by weight in the monomer
[3)]% by weight in the aqueous phase The measurement of interfacial tension between the monomer phase and aqueous phase and shearing rate of homogenizer were carried out as follows.

Interfacial tension between monomer phase and aqueous phase

A polymer was dissolved in a monomer, and likewise a polymer in water, as shown in the Table 7, in a concentration of 0.01 g/100 ml, and the interfacial tension therebetween was measured with a du Nuoy's surface and interfacial tensiometer (from K. K. Shimadzu Seisakusho, Japan).

Shearing rate of homogenizer

Figure 4:
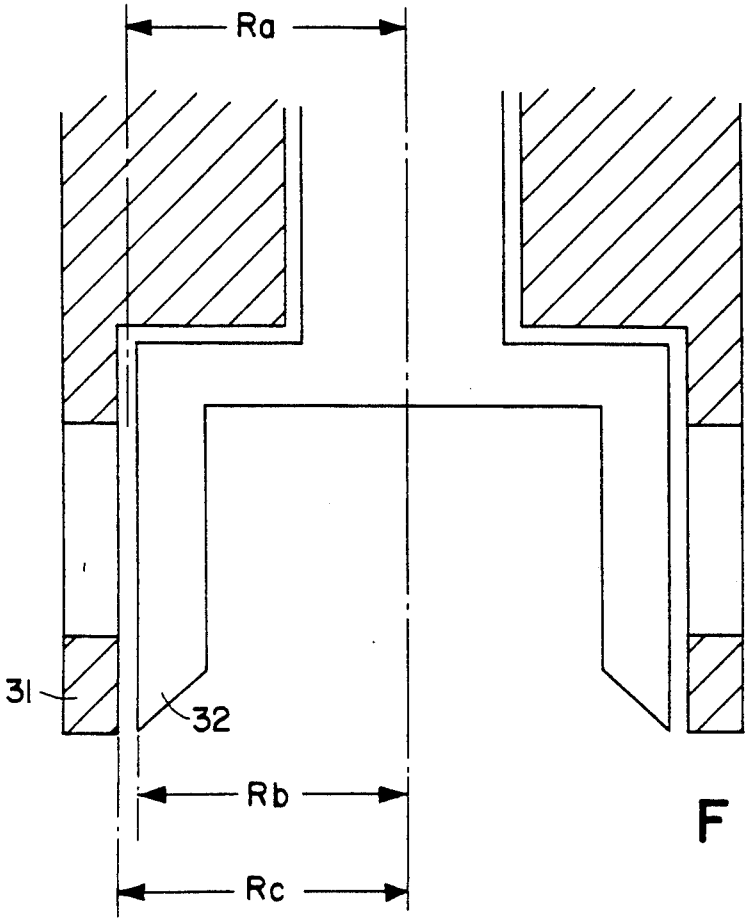
FIG. 4 is a sectional view of a homogenizing mixer preferably used for the production of toner particles according to an embodiment of the invention.

As illustrated in FIG. 4, the shearing rate of a homogenizer, i.e., the shearing rate $\gamma$ at the central portion of the gap between a stationary outer blade 31 and rotational inner blade 32, is defined by the expression, based on Ra, Rb and Rc of a generator shaft, as below:

$$\gamma = QS$$

wherein $Q = 2/[Ra^2(Rb^{-2} - Rc^{-2})]$, and S is a rotation number (rpm).

The homogenizer has an Ra of 15.9415 mm, an Rb of 15.8040 mm and an Rc of 16.0790 mm, so that Q is 57.9605. Thus, the relationship between the rotation number and shearing rate of the homegenizer is represented as shown in the Table 8. However, the relationship when the rotation number is more than 7000 rpm is calculated based on an expression applied to a Banbury mixer.

TABLE 8

| S (rpm) | $\gamma$ (second$^{-1}$) |
|---|---|
| 1000 | $0.6 \times 10^5$ |
| 3000 | $1.7 \times 10^5$ |
| 3500 | $2.0 \times 10^5$ |
| 5000 | $2.9 \times 10^5$ |
| 7000 | $4.1 \times 10^5$ |
| 10000 | $5.8 \times 10^5$ |
| 12000 | $7.0 \times 10^5$ |

RAT ($R_{40}/R_{90}$)

$R_{40}$ is a diameter of particles of 40% by volume of the particles starting from larger ones, and $R_{90}$ is a diameter of particles of 90% by volume of the particles starting from larger ones. The ratio, RAT is defined as a ratio of $R_{40}/R_{90}$. Thus, the smaller the RAT, the more narrow the size distribution.

The production of partially saponified polyvinyl acetate and styrene-acrylic acid copolymer used above is given below as Reference Examples 1 and 2, respectively.

Reference Example 1

Vinyl acetate was dissolved in benzene in a concentration of 30% by weight. An amount of 0.1% by weight based on the vinyl acetate of azobisisobutyronitrile was added to the solution. The mixture was sealed in a tube under a nitrogen gas, and the polymerization was carried out at 70° C. over a period of 48 hours to provide polyvinyl acetate.

The polymer was dissolved in methanol and reprecipitated in water, and was purified in this manner repeatedly, followed by drying at 20° C. under a reduced pressure of 20 mmHg over a period of 72 hours. An amount of 5 g of the purified polymer was dissolved in 100 ml of acetone, and to the solution was added a suitable amount of 1N aqueous solution of sodium hydroxide. The mixture was stirred at 70° C. over 24 hours to saponify the polymer. After the reaction, the polymer was purified by a reprecipitating method, and then dried at 20° C. under a reduced pressure of 20 mmHg over a period of 72 hours, to provide a partially saponified polyvinyl acetate.

An amount of 0.3–0.5 g of the partially saponified polyvinyl acetate was dissolved in methanol. An excess amount of a solution of potassium hydroxide in methanol was added to the solution of the polymer and the mixture was left standing over a period of 24 hours, followed by the addition thereto of 10 ml of deionized water and standing over 5 hours. Thereafter, the remaining amount of the potassium hydroxide was titrated with a 1N hydrochloric acid solution to determine the degree of saponification. The same operation was carried out with the unsaponified polymer to obtain a blank.

Reference Example 2

Styrene and acrylic acid were dissolved in benzene in a total concentration of 30% by weight. An amount of 0.2% by weight based on the total monomers of azobisisobutyronitrile was added to the solution. The mixture was sealed in a tube under a nitrogen gas, and the polymerization was carried out at 70° C. over a period of 48 hours to provide a styrene-acrylic acid copolymer.

The polymer was dissolved in benzene and precipitated in methanol, and was purified in this manner repeatedly, followed by drying at 20° C. under a reduced pressure of 20 mmHg over a period of 72 hours.

The amount of carboxyl groups in the copolymer was determined by an electroconductivity measurement of the solution in acetone/water.

We claim:

1. A method of producing a deformed toner particles for use in electrophotography which comprises: suspending a radical polymerizable liquid monomer containing particles of a colorant and a charge controlling agent in water; suspension polymerizing the monomer to provide spherical polymer particles composed of a matrix of the polymer and the colorant and charge controlling agent dispersed therein and having a diameter of 1–30 μm; and treating the suspension containing the polymer particles at temperatures in the range of ±10° C. of the glass transition temperature of the matrix forming the polymer particles with a wet type agitation mill, thereby to provide dislike toner particles having a diameter of 3–30 μm, a thickness of 1–15 μm and a flatness of not more than 0.5, the flatness of the dislike toner particles being defined as a ratio of average thickness to average diameter of the particles, or oval toner particles having a major axis of 3–30 μm in length, a minor axis of 1–25 μm in length and a flatness of not more than 0.5, the flatness of the oval toner particles being defined as a ratio of twice the average thickness to the sum of length of average major axis and length of average minor axis, or a mixture of these.

2. The method as claimed in claim 1 wherein the colorant is carbon black.

3. A method of producing a deformed toner particle for use in electrophotography which comprises the following steps carried out in sequence:

(a) dispersing particles of a colorant and a charge controlling agent minutely and uniformly both as finely divided particles of not more than 1 μm in particle size in a radical polymerizable liquid monomer;

(b) adding an azobisnitrile polymerization initiator to the resultant monomer composition, suspending the composition in water containing polyvinyl alcohol as a suspending agent, suspension polymerizing the monomer to provide spherical polymer particles composed of a matrix of the polymer and the colorant and charge controlling agent dispersed therein and having a diameter of 1–30 μm, and treating the suspension containing the polymer particles at temperatures in the range of ±10° C. of the glass transition temperature of the matrix forming the polymer particles with a continuous wet type agitation mill, thereby to deform the spherical particles into dislike particles having a diameter of 3–30 μm, a thickness of 1–15 μm and a flatness of not more than 0.5, the flatness of the dislike particles being defined as a ratio of average thickness to average diameter of the particles, or oval particles having a major axis of 3–30 μm in length, a minor axis of 1–25 μm in length and a flatness of not more than 0.5, the flatness of the oval particles being defined as a ratio of twice the average thickness to the sum of length of average major axis and length of average minor axis, or a mixture of these;

(c) saponifying the polyvinyl alcohol; and (d) recovering, drying and washing the polymer particles, and optionally classifying to a desired particle size.

4. The method as claimed in claim 3 wherein the colorant is first dispersed in the monomer in the presence of a peroxide polymerization initiator, and then the charge controlling agent is dispersed in the monomer.

5. The method as claimed in claim 4 wherein the colorant is carbon black.

6. The method as claimed in claim 4 wherein the peroxide polymerization initiator is lauroyl peroxide.

7. The method as claimed in claim 3 wherein the azobisnitrile polymerization initiator is azobisisobutyronitrile or azobisdimethylvaleronitrile.

* * * * *